US011015396B2

(12) United States Patent
Grosz et al.

(10) Patent No.: US 11,015,396 B2
(45) Date of Patent: May 25, 2021

(54) ROLLING ELEMENT WITH HALF LOCK-WEDGE LOCK

(71) Applicant: Halliburton Energy Services, Inc., Houston, TX (US)

(72) Inventors: Gregory Christopher Grosz, Magnolia, TX (US); Brandon James Hinz, Conroe, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 205 days.

(21) Appl. No.: 16/305,028

(22) PCT Filed: Jun. 16, 2017

(86) PCT No.: PCT/US2017/038005
§ 371 (c)(1),
(2) Date: Nov. 27, 2018

(87) PCT Pub. No.: WO2017/218975
PCT Pub. Date: Dec. 21, 2017

(65) Prior Publication Data

US 2020/0318439 A1 Oct. 8, 2020

Related U.S. Application Data

(63) Continuation of application No. PCT/US2016/037991, filed on Jun. 17, 2016.

(51) Int. Cl.
*E21B 10/43* (2006.01)
*E21B 10/14* (2006.01)
(Continued)

(52) U.S. Cl.
CPC ..... *E21B 10/43* (2013.01); *E21B 10/14* (2013.01); *E21B 10/50* (2013.01); *E21B 10/52* (2013.01); *E21B 10/567* (2013.01)

(58) Field of Classification Search
None
See application file for complete search history.

(56) References Cited

U.S. PATENT DOCUMENTS 4,006,788 A 2/1977 Garner
4,343,371 A 8/1982 Baker, III et al.
(Continued)

FOREIGN PATENT DOCUMENTS

CN 201103343 Y 8/2008
CN 103556952 A 11/2013
(Continued)

OTHER PUBLICATIONS

Office Action issued for Chinese Patent Application No. 201780030360.8, dated Oct. 9, 2019, 16 pages (with translation).
(Continued)

*Primary Examiner* — Giovanna Wright
*Assistant Examiner* — Dany E Akakpo

(57) ABSTRACT

A drill bit includes a bit body having one or more blades extending therefrom, a plurality of cutters secured to the one or more blades, and a rolling element assembly positioned within a cavity defined on the bit body. The rolling element assembly includes a rolling element rotatable within the cavity about a rotational axis, and a retainer extendable within a retainer slot defined in the cavity to secure the rolling element within the cavity. The retainer and the cavity cooperatively encircle more than 180° but less than 360° of a circumference of the rolling element while leaving a full axial width of the rolling element exposed. The retainer includes a protruding portion thereon extendable into an offset region of the retainer slot when the first retainer piece is inserted into the retainer slot in a first direction and shifted within the retainer slot in a second direction.

20 Claims, 18 Drawing Sheets

(51) Int. Cl.

| | |
|---|---|
| ***E21B 10/52*** | (2006.01) |
| ***E21B 10/50*** | (2006.01) |
| ***E21B 10/567*** | (2006.01) |

(56) References Cited

U.S. PATENT DOCUMENTS

| | | | | |
|---|---|---|---|---|
| 4,553,615 | A | 11/1985 | Grainger | |
| 4,751,972 | A | 6/1988 | Jones et al. | |
| 5,423,719 | A | 6/1995 | Jennings | |
| 6,298,930 | B1 | 10/2001 | Sinor et al. | |
| 6,460,631 | B2 | 10/2002 | Dykstra et al. | |
| 6,779,613 | B2 | 8/2004 | Dykstra et al. | |
| 6,935,441 | B2 | 8/2005 | Dykstra et al. | |
| 7,096,978 | B2 | 8/2006 | Dykstra et al. | |
| 7,703,559 | B2 | 4/2010 | Shen et al. | |
| 7,762,359 | B1 | 7/2010 | Miess | |
| 7,814,997 | B2 | 10/2010 | Aliko et al. | |
| 8,079,431 | B1 * | 12/2011 | Cooley | E21B 10/42 175/432 |
| 8,091,655 | B2 | 1/2012 | Shen et al. | |
| 8,141,665 | B2 | 3/2012 | Ganz | |
| 8,286,735 | B1 | 10/2012 | Cooley et al. | |
| 8,413,746 | B2 | 4/2013 | Shen et al. | |
| 8,459,378 | B2 | 6/2013 | Zahradnik et al. | |
| 8,459,382 | B2 | 6/2013 | Aliko et al. | |
| 8,499,859 | B1 | 8/2013 | Cooley et al. | |
| 8,678,111 | B2 | 3/2014 | Zahradnik et al. | |
| 9,284,790 | B2 | 3/2016 | Zhang et al. | |
| 2007/0158115 | A1 * | 7/2007 | Sherwood, Jr. | E21B 10/573 175/432 |
| 2007/0278017 | A1 | 12/2007 | Shen et al. | |
| 2010/0276200 | A1 | 11/2010 | Schwefe et al. | |
| 2012/0073881 | A1 | 3/2012 | Shen et al. | |
| 2012/0132471 | A1 | 5/2012 | Zhang et al. | |
| 2013/0140094 | A1 | 6/2013 | Burhan et al. | |
| 2013/0146367 | A1 | 6/2013 | Zhang et al. | |
| 2013/0220707 | A1 | 8/2013 | Shen et al. | |
| 2013/0248260 | A1 | 9/2013 | Ganz | |
| 2014/0326515 | A1 | 11/2014 | Shi et al. | |
| 2014/0360792 | A1 | 12/2014 | Azar et al. | |
| 2015/0030981 | A1 | 1/2015 | Robello et al. | |

FOREIGN PATENT DOCUMENTS

| | | | |
|---|---|---|---|
| CN | 104136705 | A | 11/2014 |
| CN | 105283623 | A | 12/2014 |
| GB | 1239074 | | 7/1971 |
| WO | WO-2015195244 | A1 | 12/2015 |
| WO | WO-2017218000 | A1 | 12/2017 |

OTHER PUBLICATIONS

Korean Intellectual Property Office, International Search Report and Written Opinion, PCT/US2017/038005, dated Aug. 29, 2017, 14 pages, Korea.

Korean Intellectual Property Office, International Search Report and Written Opinion, PCT/US2016/037991, dated Mar. 15, 2017, 11 pages, Korea.

* cited by examiner

ROLLING ELEMENT WITH HALF LOCK-WEDGE LOCK

CROSS-REFERENCE TO RELATED APPLICATIONS

This application is a U.S. national stage patent application of International Patent Application No. PCT/US2017/038005, filed on Jun. 16, 2017, which claims priority to International Patent Application Number PCT/US2016/037991, entitled Rolling Element with Half Lock, filed Jun. 17, 2016, the benefit of each of which is claimed and the disclosures of which are incorporated by reference herein in their entirety.

BACKGROUND

In conventional wellbore drilling in the oil and gas industry, a drill bit is mounted on the end of a drill string, which may be extended by adding segments of drill pipe as the well is progressively drilled to the desired depth. At the surface of the well site, a rotary drive (referred to as a "top drive") may be provided to rotate the entire drill string, including the drill bit at the end, to drill through the subterranean formation. Alternatively, the drill bit may be rotated using a downhole mud motor without having to rotate the drill string. When drilling, drilling fluid is pumped through the drill string and discharged from the drill bit to remove cuttings and debris. The mud motor, if present in the drill string, may be selectively powered using the circulating drilling fluid.

One common type of drill bit used to drill wellbores is a "fixed cutter" bit, wherein the cutters are secured to the bit body at fixed positions. This type of bit is sometimes referred to as a "drag bit" since the cutters in one respect drag rather than roll in contact with the formation during drilling. The bit body may be formed from a high strength material, such as tungsten carbide, steel, or a composite/matrix material. A plurality of cutters (also referred to as cutter elements, cutting elements, or inserts) are attached at selected locations about the bit body. The cutters may include a substrate or support stud made of a carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

In fixed cutter drill bits, PDC cutters are rigidly secured to the bit body, such as by being brazed within corresponding cutter pockets defined on blades that extend from the bit body. Some of the PDC cutters are strategically positioned along the leading edges of the blades to engage the formation during drilling. In use, high forces are exerted on the PDC cutters, particularly in the forward-to-rear direction. Over time, the working surface or cutting edge of each cutter that continuously contacts the formation eventually wears down or fails.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 12 illustrates a single-piece wedge lock retainer,

FIG. 13 illustrates a two-piece wedge lock retainer wherein a second retainer piece is a mechanical fastener, and FIG. 14 illustrates a three-piece wedge lock retainer wherein a third retainer piece fastens a first retainer piece to a second retainer piece.

DETAILED DESCRIPTION

Figure 1A:
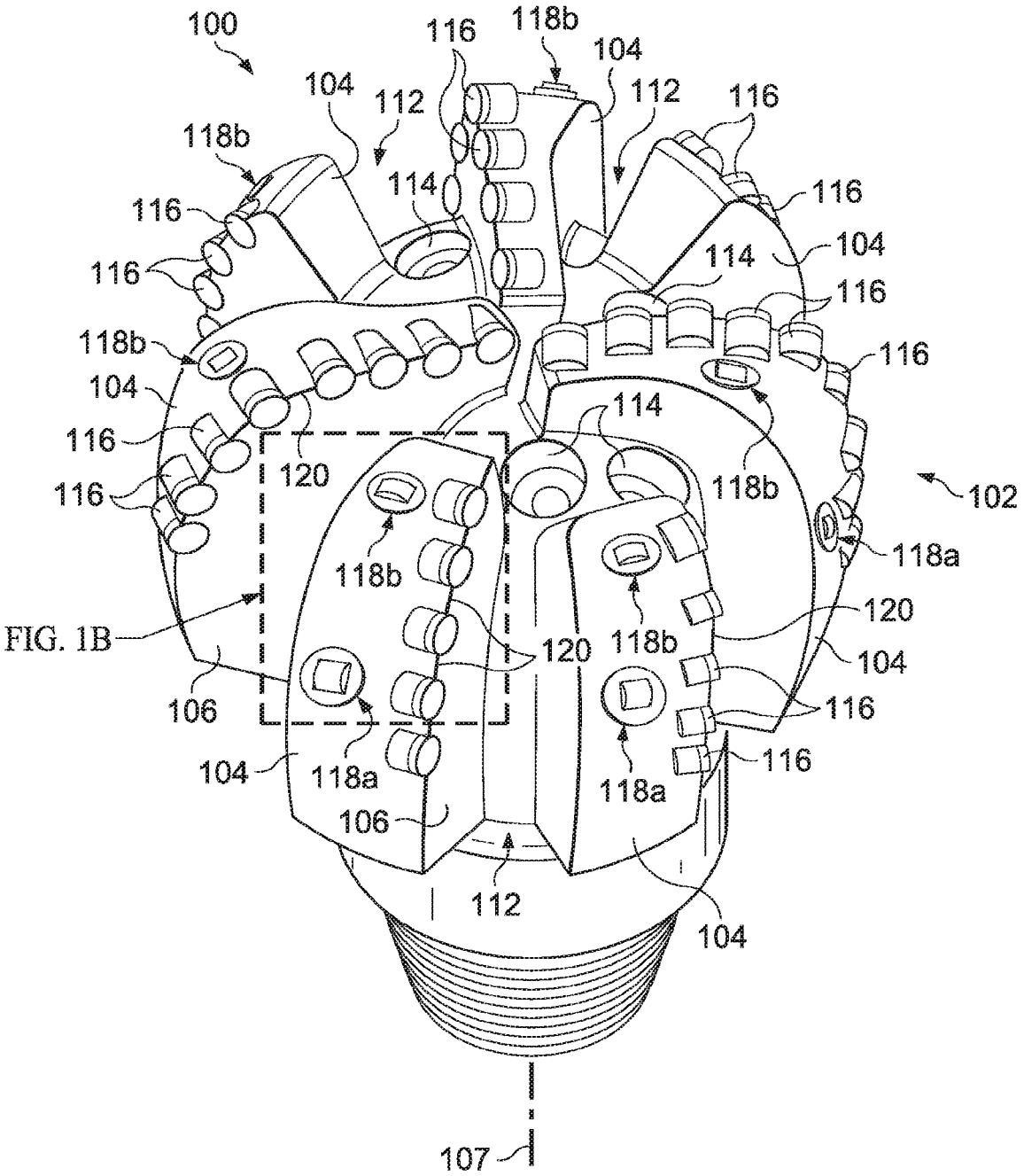
FIG. 1A illustrates an isometric view of a rotary drill bit that may employ the principles of the present disclosure.

The present disclosure relates to earth-penetrating drill bits and, more particularly, to rolling-type cutting or depth of cut control (DOCC) elements that can be used in drill bits. Embodiments of the disclosure are directed to retainers for the rolling DOCC elements that resist movement out of retainer groove, to thereby maintain the DOCC elements within a cavity for operation. The retainers may be arranged in their respective grooves such that movement of the retainers in multiple directions is required to remove the retainers from the grooves. The retainers may be wedged into the retainer grooves to prohibit movement of the retainers in at least one of the required directions in operation.

The embodiments of the present disclosure describe rolling element assemblies that can be secured within corresponding cavities provided on a drill bit. Each rolling element assembly includes a cylindrical rolling element strategically positioned and secured to the drill bit so that the rolling element is able to engage the formation during drilling. In response to drill bit rotation, and depending on the selected positioning (orientation) of the rolling element with respect to the body of the drill bit, the rolling element may roll against the underlying formation, cut against the formation, or may both roll against and cut the formation. The rolling elements of the presently disclosed rolling element assemblies are retained within corresponding cavities on the bit body using an arcuate retainer received within a retainer slot defined in the cavity.

The orientation of each rolling element with respect to the bit body is selected to produce a variety of different functions and/or effects. The selected orientation includes, for example, a selected side rake and/or a selected back rake. In some cases while drilling, the rolling element may be configured as a rolling cutting element that both rolls along the formation (e.g., by virtue of a selected range of side rake) and cuts the formation (e.g., by virtue of the selected back rake and/or side rake). More particularly, the rolling cutting element may be positioned to cut, dig, scrape, or otherwise remove material from the formation using a portion of the rolling element (e.g., a polycrystalline diamond table) that is positioned to engage the formation.

In some example embodiments, the rolling element assemblies described herein can be configured as rolling cutting elements. The rolling cutting elements may be configured to rotate freely about a rotational axis and, as a result, the entire outer edge of the rolling cutting element may be used as a cutting edge. Consequently, rather than only a limited portion of the cutting edge being exposed to the formation during drilling, as in the case of conventional fixed cutters, the entire outer edge of the rolling cutting element will be successively exposed to the formation as it rotates about its rotational axis during drilling. This results in a more uniform cutting edge wear, which may prolong the operational lifespan of the rolling cutting element as compared to conventional cutters.

In other example embodiments, the rolling element assemblies described herein can be configured as rolling depth of cut control (DOCC) elements that roll along the formation as the drill bit rotates. In a rolling DOCC element configuration, the orientation of the rolling element may be selected so that a full axial span of the rolling element bears against the formation. As with rolling cutting elements, rolling DOCC elements may exhibit enhanced wear resilience and allow for additional weight-on-bit without negatively affecting torque-on-bit. This may allow a well operator to minimize damage to the drill bit, thereby reducing trips and non-productive time, and decreasing the aggressiveness of the drill bit without sacrificing its efficiency. The rolling DOCC elements described herein may also reduce friction at the interface between the drill bit and the formation, and thereby allow for a steady depth of cut, which results in better tool face control.

In yet other example embodiments, the rolling element assemblies described herein may operate as a hybrid between a rolling cutting element and a rolling DOCC element. This may be accomplished by orienting the rotational axis of the rolling element on a plane that does not pass through the longitudinal axis of the drill bit nor is the plane oriented perpendicular to a plane that does pass through the longitudinal axis of the drill bit. Those skilled in the art will readily appreciate that the presently disclosed embodiments may improve upon hybrid rock bits, which use a large roller cone element as a depth of cut limiter by sacrificing diamond volume. In contrast, the presently disclosed rolling element assemblies are small in comparison and its enablement will not result in a significant loss of diamond volume on a fixed cutter drag bit.

FIG. 1A is an isometric view of an exemplary drill bit 100 that may employ the principles of the present disclosure. The drill bit 100 is depicted as a fixed cutter drill bit, and the present teachings may be applied to any fixed cutter drill bit category, including polycrystalline diamond compact (PDC) drill bits, drag bits, matrix drill bits, and/or steel body drill bits. While the drill bit 100 is depicted in FIG. 1A as a fixed cutter drill bit, however, the principles of the present disclosure are equally applicable to other types of drill bits operable to form a wellbore including, but not limited to, roller cone drill bits.

The drill bit 100 has a bit body 102 that includes radially and longitudinally extending blades 104 having leading faces 106. The bit body 102 may be made of steel or a matrix of a harder material, such as tungsten carbide. The bit body 102 rotates about a longitudinal drill bit axis 107 to drill into underlying subterranean formation under an applied weight-on-bit. Corresponding junk slots 112 are defined between circumferentially adjacent blades 104, and a plurality of nozzles or ports 114 can be arranged within the junk slots 112 for ejecting drilling fluid that cools the drill bit 100 and otherwise flushes away cuttings and debris generated while drilling.

The bit body 102 further includes a plurality of cutters 116 secured within a corresponding plurality of cutter pockets sized and shaped to receive the cutters 116. Each cutter 116 in this example comprises a fixed cutter secured within its corresponding cutter pocket via brazing, threading, shrink-fitting, press-fitting, snap rings, or any combination thereof. The fixed cutters 116 are held in the blades 104 and respective cutter pockets at predetermined angular orientations and radial locations to present the fixed cutters 116 with a desired back rake angle against the formation being penetrated. As the drill string is rotated, the fixed cutters 116 are driven through the rock by the combined forces of the weight-on-bit and the torque experienced at the drill bit 100. During drilling, the fixed cutters 116 may experience a variety of forces, such as drag forces, axial forces, reactive moment forces, or the like, due to the interaction with the underlying formation being drilled as the drill bit 100 rotates.

Each fixed cutter 116 may include a generally cylindrical substrate made of an extremely hard material, such as tungsten carbide, and a cutting face secured to the substrate. The cutting face may include one or more layers of an ultra-hard material, such as polycrystalline diamond, polycrystalline cubic boron nitride, impregnated diamond, etc., which generally forms a cutting edge and the working surface for each fixed cutter 116. The working surface is typically flat or planar, but may also exhibit a curved exposed surface that meets the side surface at a cutting edge.

Generally, each fixed cutter 116 may be manufactured using tungsten carbide as the substrate. While a cylindrical tungsten carbide "blank" can be used as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, the fixed cutter 116 may be referred to as a polycrystalline diamond compact cutter or a "PDC cutter," and drill bits made using such PDC fixed cutters 116 are generally known as PDC bits.

As illustrated, the drill bit 100 may further include a plurality of rolling element assemblies 118, shown as rolling element assemblies 118*a* and 118*b*. The orientation of a rotational axis of each rolling element assembly 118*a,b* with respect to a tangent to an outer surface of the blade 104 may dictate whether the particular rolling element assembly 118*a,b* operates as a rolling DOCC element, a rolling cutting element, or a hybrid of both. As mentioned above, rolling DOCC elements may prove advantageous in allowing for additional weight-on-bit (WOB) to enhance directional drilling applications without over engagement of the fixed cutters 116. Effective DOCC also limits fluctuations in torque and minimizes stick-slip, which can cause damage to the fixed cutters 116.

Figure 1B:
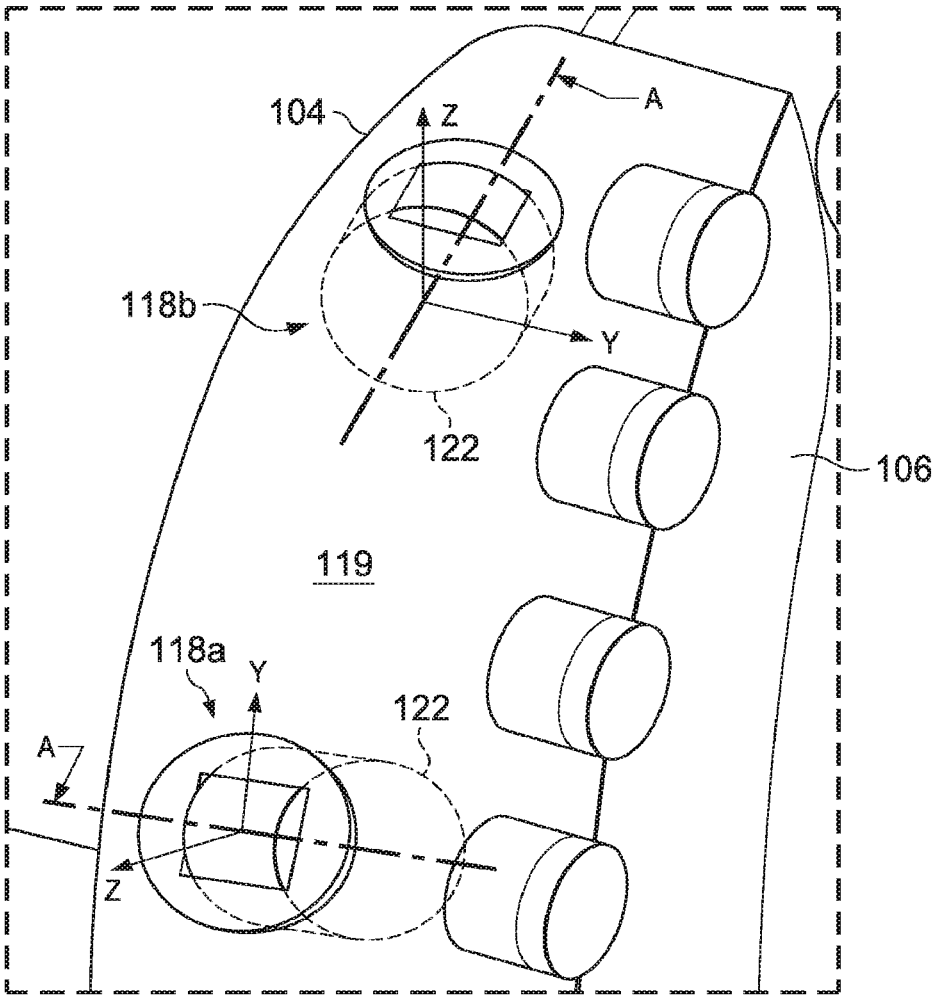
FIG. 1B illustrates an isometric view of a portion of the rotary drill bit enclosed in the indicated box of FIG. 1A.

FIG. 1B is an enlarged portion of the drill bit 100 indicated by the dashed box shown in FIG. 1A. As shown in FIG. 1B, each rolling element assembly 118*a,b* is located in the blade 104 and includes a rolling element 122. Exposed portions of the rolling elements 122 are illustrated in solid linetype, while portions of the rolling elements 122 that are seated within corresponding housings or pockets of the rolling element assemblies 118*a,b* are illustrated in dashed linetype. Each rolling element 122 has a rotational axis A, a Z-axis that is perpendicular to the blade profile 138 (FIG. 1D), and a Y-axis that is orthogonal to both the rotational and Z axes.

If, for example, the rotational axis A of the rolling element 122 is substantially parallel to a tangent to the outer surface 119 of the blade profile, the rolling element assembly 118*a,b* may generally operate as a rolling DOCC element. Said differently, if the rotational axis A of the rolling element 122 passes through or lies on a plane that passes through the longitudinal axis 107 (FIG. 1A) of the drill bit 100 (FIG. 1A), then the rolling element assembly 118*a,b* may substantially operate as a rolling DOCC element. If, however, the rotational axis A of the rolling element 122 is substantially perpendicular to the leading face 106 of the blade 104, then the rolling element assembly 118*a,b* may substantially operate as a rolling cutting element. Said differently, if the rotational axis A of the rolling element 122 is perpendicular to or lies on a plane that is perpendicular to a plane passing through the longitudinal axis 107 (FIG. 1A) of the drill bit 100 (FIG. 1A), then the rolling element assembly 118*a,b* may substantially operate as a rolling cutting element.

Accordingly, as depicted in FIG. 1B, the first rolling element assembly 118*a* may be positioned to operate as a rolling cutting element and the second rolling element assembly 118*b* may be positioned to operate as a rolling DOCC element. In embodiments where the rotational axis A of the rolling element 122 lies on a plane that does not pass through the longitudinal axis 107 (FIG. 1A) of the drill bit 100 (FIG. 1A) nor is the plane perpendicular to the longitudinal axis 107, the rolling element assembly 118*a,b* may then operate as a hybrid rolling DOCC and cutting element.

Traditional load-bearing type cutting elements for DOCC unfavorably affect torque-on-bit (TOB) by simply dragging, sliding, etc. along the formation, whereas a rolling DOCC element, such as the presently described rolling element assemblies 118*b*, may reduce the amount of torque needed to drill a formation because it rolls to reduce friction losses typical with load bearing DOCC elements. A rolling DOCC element will also have reduced wear as compared to a traditional bearing element. As will be appreciated, however, one or more of the rolling element assemblies 118*b* can also be used as rolling cutting elements, which may increase cutter effectiveness since it will distribute heat more evenly over the entire cutting edge and minimize the formation of localized wear flats on the rolling cutting element.

Figure 1C:
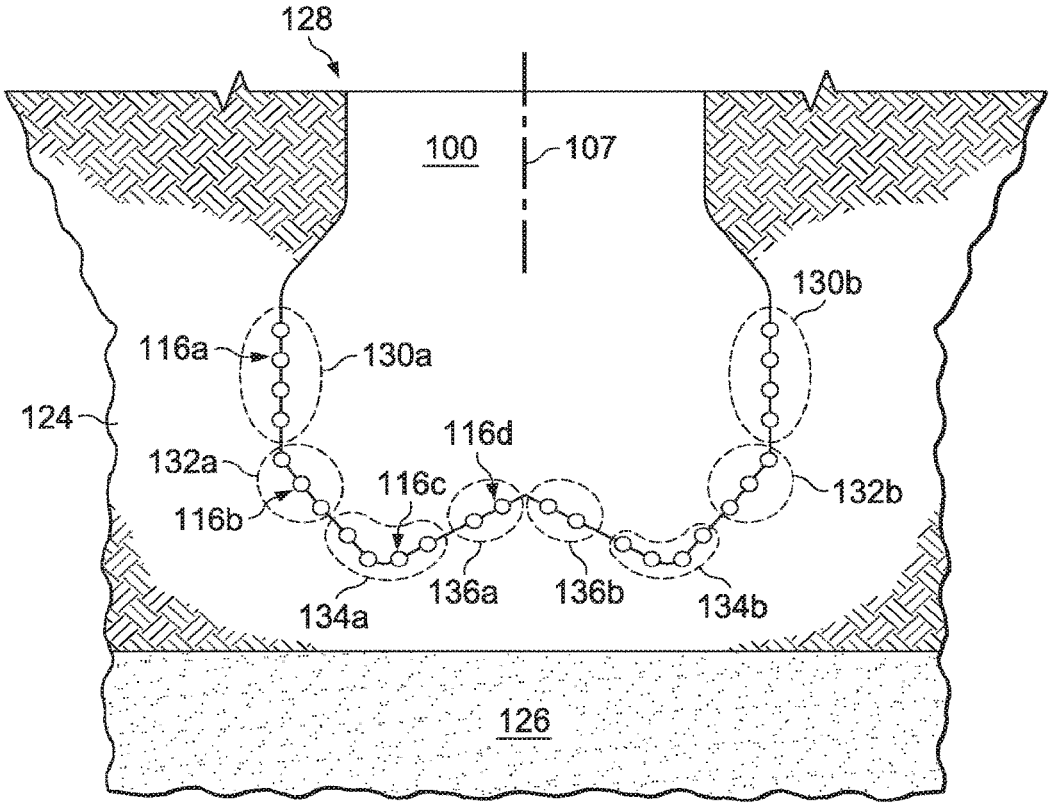
FIG. 1C illustrates a drawing in section and in elevation with portions broken away showing the drill bit of FIG. 1.

FIG. 1C is a drawing in section and in elevation with portions broken away showing the drill bit 100 drilling a wellbore through a first downhole formation 124 and into an underlying second downhole formation 126. The first downhole formation 124 may be described as softer or less hard when compared to the second downhole formation 126. Exterior portions of the drill bit 100 that contact adjacent portions of the first and/or second downhole formations 124, 126 may be described as a bit face, and are projected rotationally onto a radial plane to provide a bit face profile 128. The bit face profile 128 of the drill bit 100 may include various zones or segments and may be substantially symmetric about the longitudinal axis 107 of the drill bit 100 due to the rotational projection of the bit face profile 128, such that the zones or segments on one side of the longitudinal axis 107 may be substantially similar to the zones or segments on the opposite side of the longitudinal axis 107.

For example, the bit face profile 128 may include a first gage zone 130*a* located opposite a second gage zone 130*b*, a first shoulder zone 132*a* located opposite a second shoulder zone 132*b*, a first nose zone 134*a* located opposite a second nose zone 134*b*, and a first cone zone 136*a* located opposite a second cone zone 136*b*. The fixed cutters 116 included in each zone may be referred to as cutting elements of that zone. For example, the fixed cutters 116*a* included in gage zones 130*a,b* may be referred to as gage cutting elements, the fixed cutters 116*b* included in shoulder zones 132*a,b* may be referred to as shoulder cutting elements, the fixed cutters 116*c* included in nose zones 134*a,b* may be referred to as nose cutting elements, and the fixed cutters 116*d* included in cone zones 136*a,b* may be referred to as cone cutting elements.

Cone zones 136*a,b* may be generally concave and may be formed on exterior portions of each blade 104 (FIG. 1A) of the drill bit 100, adjacent to and extending out from the longitudinal axis 107. The nose zones 134*a,b* may be generally convex and may be formed on exterior portions of each blade 104, adjacent to and extending from each cone zone 136. Shoulder zones 132*a,b* may be formed on exterior portions of each blade 104 extending from respective nose zones 134*a,b* and may terminate proximate to a respective gage zone 130*a,b*. The area of the bit face profile 128 may depend on cross-sectional areas associated with zones or segments of the bit face profile 128 rather than on a total number of fixed cutters 116, a total number of blades 104, or cutting areas per fixed cutter 116.

Figure 1D:
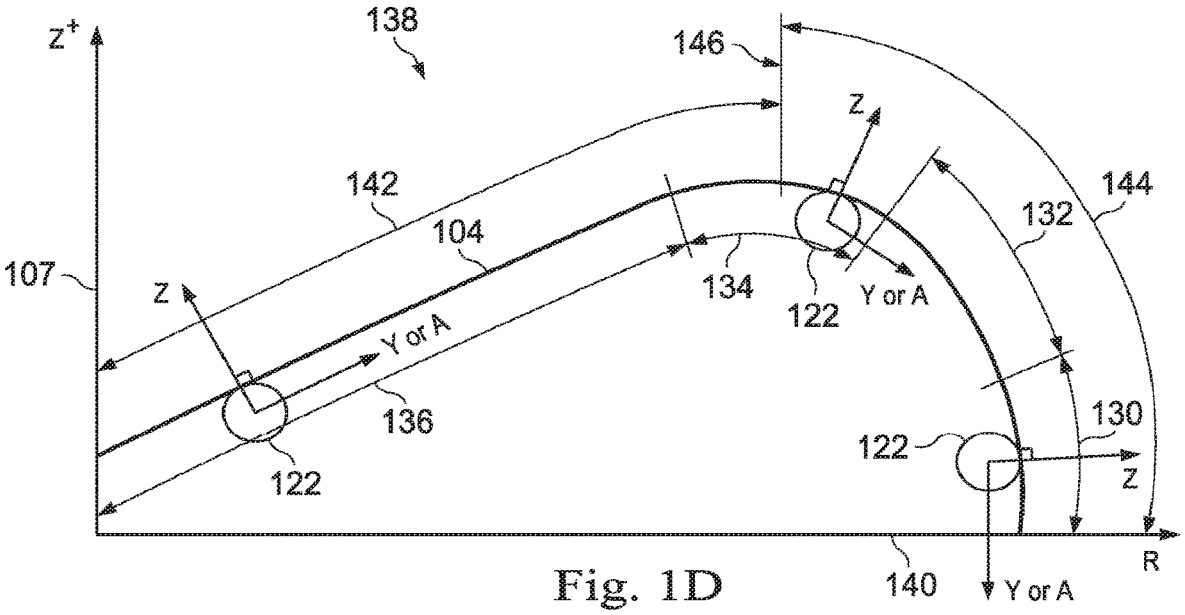
FIG. 1D illustrates a blade profile that represents a cross-sectional view of a blade of the drill bit of FIG. 1.

FIG. 1D illustrates a blade profile 138 that represents a cross-sectional view of one of the blades 104 of the drill bit 100 (FIG. 1A). The blade profile 138 includes the cone zone 136, the nose zone 134, the shoulder zone 132 and the gage zone 130, as described above with respect to FIG. 1C. Each zone 130, 132, 134, 135 may be based on its respective location along the blade 104 with respect to the longitudinal axis 107 and a horizontal reference line 140 that indicates a distance from the longitudinal axis 107 in a plane perpendicular to the longitudinal axis 107. A comparison of FIGS. 1C and 1D shows that the blade profile 138 of FIG. 1D is upside down with respect to the bit face profile 128 of FIG. 1C.

The blade profile 138 includes an inner zone 142 and an outer zone 144. The inner zone 142 extends outward from the longitudinal axis 107 to a nose point 146, and the outer zone 144 extends from the nose point 146 to the end of the blade 104. The nose point 146 may be a location on the blade profile 138 within the nose zone 134 that has maximum elevation as measured by the bit longitudinal axis 107 (vertical axis) from reference line 140 (horizontal axis). A coordinate on the graph in FIG. 1D corresponding to the longitudinal axis 107 may be referred to as an axial coordinate or position. A coordinate corresponding to reference line 140 may be referred to as a radial coordinate or radial position that indicates a distance extending orthogonally from the longitudinal axis 107 in a radial plane passing through longitudinal axis 107. For example, in FIG. 1D, the longitudinal axis 107 may be placed along a Z-axis and the reference line 140 may indicate the distance (R) extending orthogonally from the longitudinal axis 107 to a point on a radial plane that may be defined as the Z-R plane.

Depending on how the rotational axis A (FIG. 1B) of each rolling element assembly 118*a,b* (FIG. 1B) is oriented with respect to the longitudinal axis 107, and, more particularly with respect to the Z-R plane that passes through the longitudinal axis 107, the rolling assemblies 118*a,b* may operate as a rolling DOCC element, a rolling cutting element, or a hybrid thereof. The rolling element assembly 118*a,b* will generally operate as a rolling DOCC element if the rotational axis A of the rolling element 122 lies on the Z-R plane, but will generally operate as a rolling cutting element if the rotational axis A of the rolling element 122 lies on a plane perpendicular to the Z-R plane. The rolling element assembly 118*a,b* may operate as a hybrid rolling DOCC element and a rolling cutting element in embodiments where the rotational axis A of the rolling element 122 lies on a plane offset from the Z-R plane, but not perpendicular thereto.

Depending on how they are oriented with respect to the longitudinal axis 107, each rolling element assembly 118*a,b* (FIG. 1B) may exhibit side rake or back rake during operation. Side rake can be defined as the angle between the rotational axis A (FIG. 1B) of the rolling element 122 and the Z-R plane that extends through the longitudinal axis 107. When the rotational axis A is parallel to the Z-R plane, the side rake is substantially 0°, such as in the case of the second rolling element assembly 118*b* of FIG. 1B. When the rotational axis A is perpendicular to the Z-R plane, however, the side rake is substantially 90°, such as in the case of the first rolling element assembly 118*a* of FIG. 1B. When viewed along the Z-axis from the positive Z-direction (viewing toward the negative Z-direction), a negative side rake results from counterclockwise rotation of the rolling element 122, and a positive side rake results from clockwise rotation of the rolling element 122. Said differently, when viewing from the top of the blade profile 128, a negative side rake results from counterclockwise rotation of the rolling element 122, and a positive side rake results from clockwise rotation of the rolling element 122 about the Z-axis.

Back rake can be defined as the angle subtended between the Z-axis of a given rolling element 122 and the Z-R plane. More particularly, as the Z-axis of a given rolling element 122 rotates offset backward or forward from the Z-R plane, the amount of offset rotation is equivalent to the measured back rake. If, however, the Z-axis of a given rolling element 122 lies on the Z-R plane, the back rake for that rolling element 122 will be 0°.

In some embodiments, one or more of the rolling element assemblies 118*a,b* may exhibit a side rake that ranges between 0° and 45° (or 0° and −45°), or alternatively a side rake that ranges between 45° and 90° (or −45° and −90°). In other embodiments, one or more of the rolling element assemblies 118*a,b* may exhibit a back rake that ranges between 0° and 45° (or 0° and −45°). The selected side rake will affect the amount of rolling versus the amount of sliding that a rolling element 122 included with the rolling element assembly 118*a,b* will undergo, whereas the selected back rake will affect how a cutting edge of the rolling element 122 engages the formation (e.g., the first and second formations 124, 126 of FIG. 1C) to cut, scrape, gouge, or otherwise remove material.

Referring again to FIG. 1A, the second rolling element assemblies 118*b* may be placed in the cone region of the drill bit 100 and otherwise positioned so that rolling element assemblies 118*b* track in the path of the adjacent fixed cutters 116; e.g., they are placed in a secondary row behind the primary row of fixed cutters 116 on the blade 104. However, since the second rolling element assemblies 118*b* are able, to roll, they can be placed in positions other than the cone without affecting TOB.

Strategic placement of the first and second rolling element assemblies 118*a,b* may further allow them to be used as either primary and/or secondary rolling cutting elements as well as rolling DOCC elements, without departing from the scope of the disclosure. For instance, in some embodiments, one or more of the rolling element assemblies 118*a,b* may be located in a kerf forming region 120 located between adjacent fixed cutters 116. During operation, the kerf forming region 120 results in the formation of kerfs on the underlying formation being drilled. One or more of the rolling element assemblies 118*a,b* may be located on the bit body 102 such that they will engage and otherwise extend across one or multiple formed kerfs during drilling operations. In such an embodiment, the rolling element assemblies 118*a,b* may also function as prefracture elements that roll on top of or otherwise crush the kerf(s) formed on the underlying formation between adjacent fixed cutters 116. In other cases, one or more of the rolling element assemblies 118*a,b* may be positioned on the bit body 102 such that they will proceed between adjacent formed kerfs during drilling operations. In yet other embodiments, one or more of the rolling element assemblies 118*a,b* may be located at or adjacent the apex of the drill bit 100 (i.e., at or near the longitudinal axis 107). In such embodiments, the drill bit 100 may fracture the underlying formation more efficiently.

In some embodiments, as illustrated, the rolling element assemblies 118*a,b* may each be positioned on a respective blade 104 such that the rolling element assemblies 118*a,b* extend orthogonally from the outer surface 119 (FIG. 1B) of the respective blade 104. In other embodiments, however, one or more of the rolling element assemblies 118*a,b* may be positioned at a predetermined angular orientation (three degrees of freedom) offset from normal to the profile of the outer surface 119 of the respective blade 104. As a result, the rolling element assemblies 118*a,b* may exhibit an altered or desired back rake angle, side rake angle, or a combination of both. As will be appreciated, the desired back rake and side rake angles may be adjusted and otherwise optimized with respect to the primary fixed cutters 116 and/or the surface 119 (FIG. 1B) of the blade 104 on which the rolling element assemblies 118*a,b* are disposed.

Figure 2:
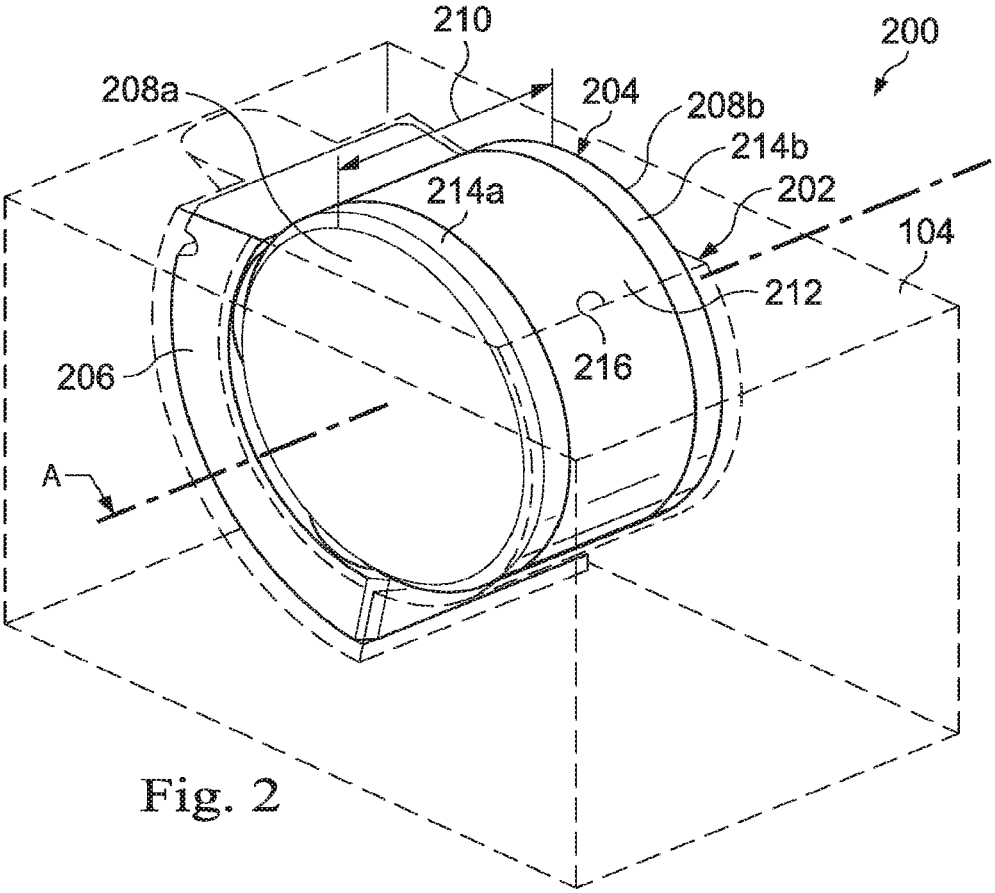
FIG. 2 is an isometric view of one example of a rolling element assembly.

FIG. 2 is an isometric view of one example of a rolling element assembly 200, according to one or more embodiments. The rolling element assembly 200 may be used, for example, with the drill bit 100 of FIGS. 1A-1B, in which case the rolling assembly 200 may be a substitution for either of the rolling element assemblies 118*a,b* or a specific example embodiment of the rolling element assemblies 118*a,b*. As illustrated, the rolling element assembly 200 may be positioned within a cavity 202 defined in a blade 104 of the drill bit 100. While the cavity 202 is shown as being defined in the blade 104, it will be appreciated that the principles of the present disclosure are equally applicable to the cavity 202 being defined on other locations of the drill bit 100, without departing from the scope of the disclosure.

The blade 104 is depicted in FIG. 2 in phantom to allow the component parts of the rolling element assembly 200 to be viewed. Moreover, only a portion of the blade 104 is represented in FIG. 2 and depicted in the general shape of a cube. In embodiments where the drill bit 100 is made of a matrix material, the cavity 202 may be formed by selectively placing displacement materials (i.e., consolidated sand or graphite) at the location where the cavity 202 is to be formed. In embodiments where the drill bit 100 comprises a steel body drill bit, conventional machining techniques may be employed to machine the cavity 202 to desired dimensions at the desired location.

The rolling element assembly 200 includes a rolling element 204 that comprises a generally cylindrical or disk-shaped body having a first axial end 208*a* and a second axial end 208*b* opposite the first axial end 208*a*. The distance between the first and second axial ends 208*a,b* is referred to herein as the axial width 210 of the rolling element 204.

The rolling element 204 includes a substrate 212 and opposing diamond tables 214*a* and 214*b* arranged at the first and second axial ends 208*a,b*, respectively, and otherwise coupled to opposing axial ends of the substrate 212. The substrate 212 may be formed of a variety of hard or ultrahard materials including, but not limited to, steel, steel alloys, tungsten carbide, cemented carbide, any derivatives thereof, and any combinations thereof. Suitable cemented carbides may contain varying proportions of titanium carbide (TiC), tantalum carbide (TaC), and niobium carbide (NbC). Additionally, various binding metals may be included in the substrate 212, such as cobalt, nickel, iron, metal alloys, or mixtures thereof. In the substrate 212, the metal carbide grains are supported within a metallic binder, such as cobalt. In other cases, the substrate 212 may be formed of a sintered tungsten carbide composite structure or a diamond ultrahard material, such as polycrystalline diamond (PCD) or thermally stable polycrystalline diamond (TSP).

The diamond tables 214*a,b* may be made of a variety of ultrahard materials including, but not limited to, polycrystalline diamond (PCD), thermally stable polycrystalline diamond (TSP), cubic boron nitride, impregnated diamond, nanocrystalline diamond, ultra-nanocrystalline diamond, and zirconia. Such materials are extremely wear-resistant and are suitable for use as bearing surfaces, as herein described.

The rolling element 204 may comprise and otherwise include one or more cylindrical bearing portions. More particularly, in this example, the entire rolling element 204 is cylindrical and made of hard, wear-resistant materials, and thus any portion of the rolling element 204 may be considered as a cylindrical bearing portion to the extent it slidingly engages a bearing surface of the cavity 202 or another component of the rolling element assembly 200 when rolling, such as would be expected during drilling operations. In some embodiments, for instance, one or both of the diamond tables 214*a,b* may be considered cylindrical bearing portions for the rolling element 204. In other embodiments, one or both of the diamond tables 214*a,b* may be omitted from the rolling element 204 and the substrate 212 may alternatively be considered as a cylindrical bearing portion. In yet other embodiments, the entire cylindrical or disk-shaped rolling element 204 may be considered as a cylindrical bearing portion and may be made of any of the hard or ultra-hard materials mentioned herein, without departing from the scope of the disclosure.

It should be noted that the features of the rolling element 204 are shown for illustrative purposes only and may or may not be drawn to scale. Consequently, the rolling element 204 as depicted should not be considered as limiting the scope of the present disclosure. For example, the thickness or axial extent of both the diamond tables 214*a,b* may or may not be the same. In at least one embodiment, one of the diamond tables 214*a,b* may be thicker than the other. Moreover, in some embodiments, one of the diamond tables 214*a,b* may be omitted from the rolling element 204 altogether. In yet other embodiments, the substrate 212 may be omitted and the rolling element 204 may instead be made entirely of the material of the diamond tables 214*a,b*.

The rolling element assembly 200 also includes a retainer 206 used to help secure or retain the rolling element 204 in the cavity 202 during use. More particularly, the cavity 202 provides and otherwise defines an opening 216 large enough to receive the rolling element 204. When seated within the cavity 202, an arcuate portion of the rolling element 204 extends out of cavity 202 to expose the full axial width 210 of the rolling element 204. The retainer 206 may subsequently be inserted into the cavity 202, and the cavity 202 and the retainer 206 cooperatively retain the rolling element 204 within the cavity 202. This is accomplished as portions of the cavity 202 and the retainer 206 jointly encircle more than 180° of the circumference of the rolling element 204, but less than 360°, so that the full axial width 210 of the rolling element 204 remains exposed for external contact with a formation during operation.

During drilling operations, the rolling element 204 is able to rotate within the cavity 202 about a rotational axis A of the rolling element 204. As the rolling element 204 rotates about the rotational axis A, the arcuate portion of the rolling element 204 extending out of the cavity 202 and otherwise exposed through the opening 216 engages (i.e., cut, roll against, or both) the underlying formation. This allows the full axial width 210 of the rolling element 204 across the entire outer circumferential surface to progressively be used as the rolling element 204 rotates during use.

Figure 3:
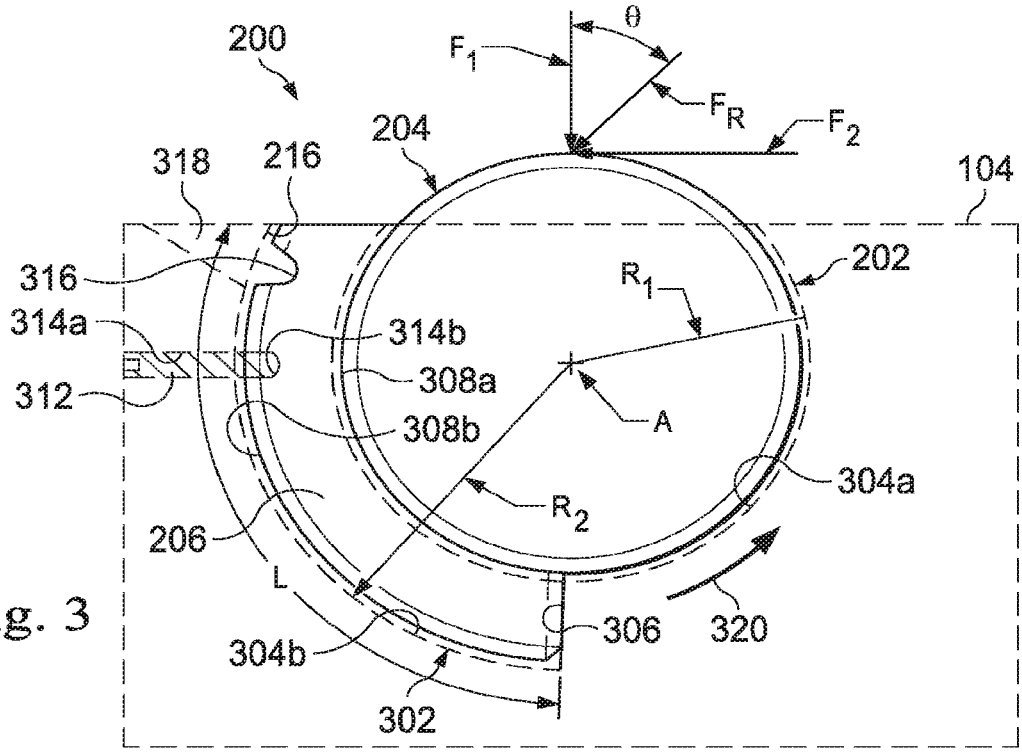
FIG. 3 is a side view of the rolling element assembly of FIG. 2.

FIG. 3 is a side view of the rolling element assembly 200 as installed within the cavity 202 defined in the blade 104. Again, the blade 104 is depicted in FIG. 3 in phantom to allow the component parts of the rolling element assembly 200 to be viewed, and only a portion of the blade 104 is represented in FIG. 2 and depicted in the general shape of a cube.

As illustrated, the cavity 202 may provide or otherwise define a retainer slot 302 configured to receive and seat the retainer 206. More specifically, the cavity 202 may provide a first arcuate portion 304*a* that extends from one side of the opening 216 and a second arcuate portion 304*b* that extends from the opposing side of the opening 216. The first arcuate portion 304*a* exhibits a first radius $R_1$ and the second arcuate portion 304*b* exhibits a second radius $R_2$ that is greater than first radius $R_1$, and an end wall 306 provides a transition between the first and second arcuate portions 304*a,b*. With a larger second radius $R_2$, the second arcuate portion 304*b* is sized to accommodate the retainer 206 within the cavity 202. Accordingly, the retainer slot 302 is defined, at least in part, by the second arcuate portion 304*b* and the end wall 306.

The retainer 206 provides an inner arcuate surface 308*a* and an outer arcuate surface 308*b* opposite the inner arcuate surface 308*a*. With the retainer 206 received within the retainer slot 302, the outer arcuate surface 308*b* will be disposed against or otherwise adjacent the second arcuate portion 304*b* and the inner arcuate surface 308*a* will be disposed against or otherwise adjacent the outer circumferential surface of the rolling element 204. Moreover, the retainer 206 is sized such that the curvature of the first arcuate portion 304*a* will transition smoothly to the curvature of the inner arcuate surface 308*a* to enable the rolling element 204 to bear against a continuously (uniformly) curved surface at all angular locations within the cavity 202 during operation.

The retainer 206 can be made of any of the hard or ultra-hard materials mentioned above for the substrate 212 and the diamond tables 214*a,b*. More specifically, the retainer 206 may be made of a material such as, but not limited to, steel, a steel alloy, tungsten carbide, a sintered tungsten carbide composite structure, cemented carbide, polycrystalline diamond (PCD), thermally stable polycrystalline diamond (TSP), cubic boron nitride, impregnated diamond, nanocrystalline diamond, ultra-nanocrystalline diamond, zirconia, any derivatives thereof, and any combinations thereof. Alternatively, or in addition thereto, the retainer 206 may be made of an engineering metal, a coated material (i.e., using processes such as chemical vapor deposition, plasma vapor deposition, etc.), or other hard or abrasion-resistant materials.

The retainer 206 may be secured within the cavity 202 (e.g., the retainer slot 302) using a variety attachment means or techniques such as, but not limited to, brazing, welding, an industrial adhesive, press-fitting, shrink-fitting, one or more mechanical fasteners (e.g., screws, bolts, snap rings, pins, a ball bearing retention mechanism, a locking wire, etc.), or any combination thereof. In at least one embodiment, as illustrated, a set screw 312 (shown in dashed lines) or the like may be used to secure the retainer 206 within the retainer slot 302. In the illustrated embodiment, the set screw 312 may be extended through a hole 314*a* defined in the blade 104, such as a trailing face of the blade 104, and threaded into a correspondingly aligned hole 314*b* defined in the retainer 206. It will be appreciated, however, that the set screw 312 may be used to secure the retainer 206 within the retainer slot 302 via alternately defined holes provided in other locations, without departing from the scope of the disclosure.

In some embodiments, the retainer 206 may define or otherwise provide an extraction feature 316 used to help extract the retainer 206 from the cavity 202 when desired. The extraction feature 316 may comprise any negative or positive alteration in the geometrical shape of the retainer 206 that provides a location where the retainer 206 may be gripped or otherwise engaged to pry (rotate) the retainer 206 out of the retainer slot 302. Negative alterations, for example, comprise material removal from the geometrical shape of the retainer 206, while positive alterations comprise material additions to the geometrical shape. In some embodiments, as illustrated, the extraction feature 316 may comprise a groove, depression, or channel (i.e., a negative alteration) defined on the outer arcuate surface 308*b* of the retainer 206. In other embodiments, however, the extraction feature 316 may alternatively be provided on one or both of the sidewalls of the retainer 206, without departing from the scope of the disclosure.

When it is desired to remove the retainer 206 from the cavity 202, a user may access and engage the extraction feature 316 with a rigid contrivance (e.g., a pick, a screwdriver, a rigid rod, etc.) and pry (rotate) the retainer 206 out of the retainer slot 302. In at least one embodiment, as illustrated, an access groove 318 may be defined in the upper surface of the blade 104 to provide a location where a user can access the extraction feature 316 and gain leverage over the retainer 206 to pry it out of the cavity 202. In the illustrated embodiment, where the extraction feature 316 is provided on the outer arcuate surface 308*b* of the retainer 206, the access groove 318 will be defined in the upper surface of the blade 104 adjacent the outer arcuate surface 308*b* of the retainer 206. In embodiments where the extraction feature 316 is alternatively provided on one or both of the sidewalls of the retainer 206, as mentioned above, the access groove 318 will be defined in the upper surface of the blade 104 adjacent one or both of the sidewalls of the retainer 206. In embodiments where the retainer 206 is brazed into the cavity 202, the braze may first be melted prior to extracting the retainer 206.

The rolling element assembly 200 may be arranged on the blade 104 such that the rolling element 204 will rotate about the rotational axis A in a first direction 320 during operation. As the rolling element 204 engages an underlying subterranean formation and rotates about the rotational axis A, a weight on bit (WOB) force $F_1$ and a friction force $F_2$ will act on the rolling element 204. The WOB force $F_1$ is the weight force applied to the rolling element 204 in the direction of advancement of the drill bit 100 (FIGS. 1A-1B). The friction force $F_2$ is a drag force assumed by the rolling element 204 and applied in the direction opposite rotation of the drill bit 100. Based on the respective magnitudes of the WOB force $F_1$ and the friction force $F_2$, a resultant force $F_R$ will be assumed by the rolling element 204. The magnitude of the resultant force $F_R$ may be determined as follows:

$$F_R^2 = F_1^2 + F_2^2 \qquad \text{Equation (1)}$$

And the resultant force $F_R$ vector will be directed at an angle θ offset from the WOB force $F_1$. The angle θ may be determined as follows:

$$\theta = \arctan\frac{F_2}{F_1} \qquad \text{Equation (2)}$$

If the direction of the resultant force $F_R$ vector intersects the retainer 206 as positioned within the retainer slot 302, then the retainer 206 may not only be used to help retain the rolling element 204 in the cavity 202, but may also prove useful as a bearing element that assumes at least a portion of the resultant force $F_R$ of the rolling element 204 during drilling operations. If, however, the direction of the resultant force $F_R$ vector does not intersect the retainer 206, then the retainer 206 will primarily serve as a structure that helps retain the rolling element 204 in the cavity 202.

In the illustrated embodiment, an arc length L of the retainer 206 is long enough such that the resultant force $F_R$ vector will intersect the retainer 206, which allows the retainer 206 to operate as a retaining structure and a bearing element. In other embodiments, however, and depending on known or predicted drilling parameters, the arc length L of the retainer 206 may be increased or decreased to allow the retainer 206 to operate as a retaining structure and a bearing element, or only as a retaining element. As will be appreciated, the respective arc lengths of the first and second arcuate surfaces 304*a,b* and the location of the end wall 306 will correspondingly be altered to accommodate the change to the arc length L. Moreover, because of the arcuate shape of the retainer 206, the maximum arc length L will be limited to the size of the opening 216.

Accordingly, the retainer 206 not only helps secure the rolling element 204 in the cavity 202, but can also serve as a bearing surface that supports and guides the rolling element 204 and may assume most (if not all) of the load exerted on the rolling element 204. In contrast, the first arcuate surface 304*a* may see only minimal loads under normal operation conditions. Given the design of the rolling element assembly 200, the force exerted on the retainer 206 during operation may be primarily compressive in nature. Having the retainer 206 made of a hard or ultra-hard material may help reduce the amount of friction and wear between the rolling element 204 and the retainer 206 as the rolling element 204 bears and slides against the inner arcuate surface 308*a*. Consequently, the hard or ultra-hard materials of the support bearing 206 may reduce or eliminate the need for lubrication between the retainer 206 and the rolling element 204. In at least one embodiment, however, the inner arcuate surface 308*a* may be polished so as to reduce friction between the opposing surfaces. The inner arcuate surface 308*a* may be polished, for example, to a surface finish of about 40 micro-inches or better.

Moreover, as the rolling element 204 rotates in the first direction 320, it inherently urges the retainer 206 to remain secured in the cavity 202. More particularly, the friction generated between the outer circumference of the rolling element 204 and the inner arcuate surface 304*a* of the retainer 206 will continuously provide a force that urges the retainer 206 against the end wall 306 and otherwise deeper into the cavity 202. Consequently, minimal retention means (i.e., brazing, welding, industrial adhesives, press-fitting, shrink-fitting, mechanical fasteners, etc.) may be required to maintain the retainer 206 within the cavity 202.

It should be noted that, although the rolling element assembly 200 has been described as retaining one rolling element 204, embodiments of the disclosure are not limited thereto and the rolling element assembly 200 (or any of the rolling element assemblies described herein) may include and otherwise use two or more rolling elements 204, without departing from the scope of the disclosure. In such embodiments, the multiple rolling elements 204 may be retained within the cavity 202 using the retainer 206 or each rolling element 204 may be supported by individual retainers 206.

Figure 4A:
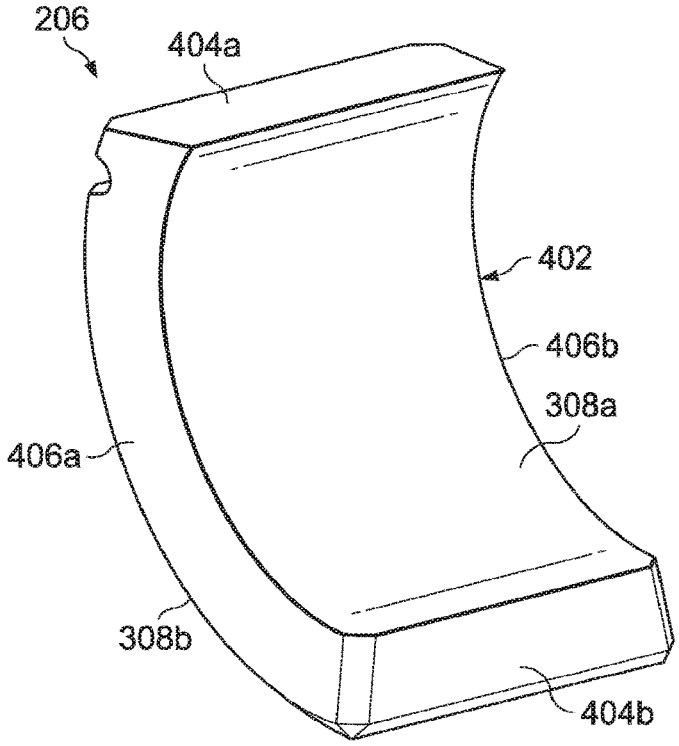
FIGS. 4A and 4B are isometric an end views, respectively, of an example embodiment of the retainer of FIGS. 2 and 3.
Figure 4B:
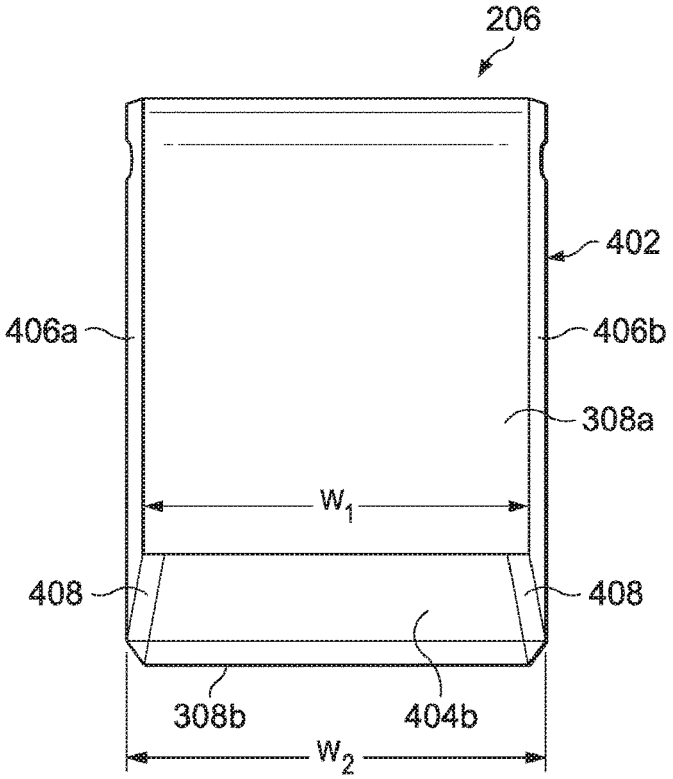

FIGS. 4A and 4B are isometric and end views, respectively, of an example embodiment of the retainer 206. As illustrated in FIG. 4A, the retainer 206 may include a generally arcuate body 402 having a first end 404*a*, a second end 404*b*, the inner arcuate surface 308*a*, the outer arcuate surface 308*b*, a first sidewall 406*a*, and a second sidewall 406*b*. The inner and outer arcuate surfaces 308*a,b* extend between the first and second ends 404*a,b*. The second end 404*b* may be configured to engage or come into close contact with the end wall 306 (FIG. 3) when the retainer 206 is inserted into the retainer slot 302 (FIG. 3). The first and second sidewalls 406*a, b* extend radially between the inner and outer arcuate surfaces 308*a,b* on each axial end of the retainer 206.

In some embodiments, as shown in FIG. 4B, some or all of the body 402 of the retainer 206 may exhibit a polygonally symmetric crossectional shape. As used herein, the term "polygonally-symmetric" refers to a cross-sectional shape that is polygonal and symmetric on both axial sides of the shape. In the illustrated, embodiment, the retainer 206 exhibits a generally dovetail cross-sectional shape. More particularly, the inner arcuate surface 308*a* may exhibit a first width $W_1$ and the outer arcuate surface 308*b* may exhibit a second width $W_2$ greater than the first width $W_1$. Accordingly, the sidewalls 406*a, b* may taper inward as extending radially from the outer arcuate surface 308*b* to the inner arcuate surface 308*a*. In embodiments where the retainer 206 is brazed into the retainer slot 302 (FIG. 3), the tapered sidewalls 406*a, b* may prove advantageous in helping prevent the retainer 206 from shifting out of the retainer slot 302 during the brazing process. It will be appreciated, however, that other polygonally-symmetric cross-sectional shapes may also be employed, such as a T-shaped body 402, without departing from the scope of the disclosure. Moreover, some or all of the body 402 of the retainer 206 may alternatively exhibit rounded features or polygonally asymmetric cross-sectional shape, as discussed in more detail below.

In some embodiments, the transition corners 408 between the second end 404*b* and the first and second sidewalls 406*a, b* and of the retainer 206 may be chamfered or radiused. Chamfered or radiused transition corners 408 may help with ease of installation of the retainer into the retainer slot 302 (FIG. 3). In other embodiments, however, the transition corners 408 may be angled, such as including a 90° (or substantially 90°) transition between the second end 404*b* and the first and second sidewalls 406*a, b* of the retainer 206, without departing from the scope of the disclosure.

Figure 5A:
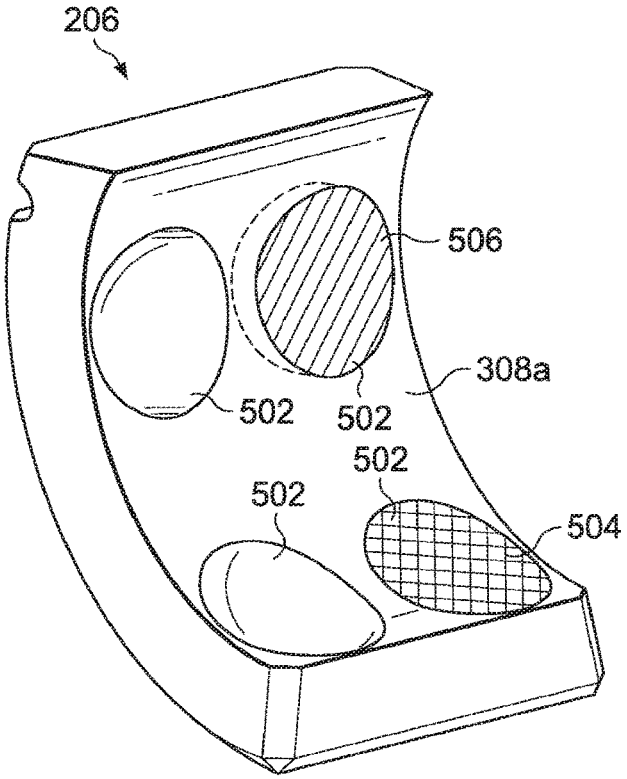
FIGS. 5A and 5B are isometric front and back views, respectively, of another example embodiment of the retainer of FIGS. 2 and 3.
Figure 5B:
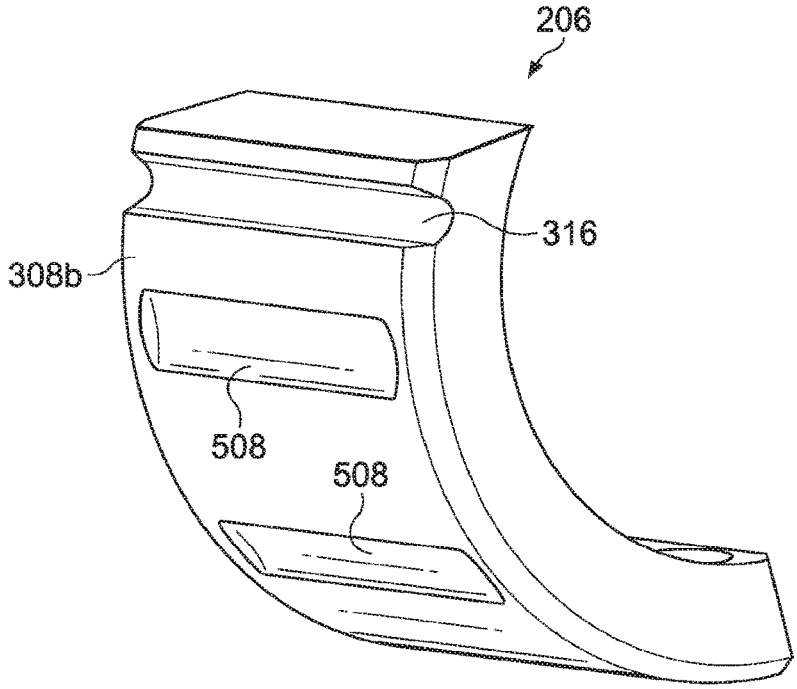

FIGS. 5A and 5B are isometric front and back views, respectively, of another example embodiment of the retainer 206. As depicted in FIG. 5A, in some embodiments, one or more depressions 502 (four shown) may be defined in the inner arcuate surface 308*a* of the retainer 206. One or more of the depressions 502 may be used to retain and otherwise receive a hardfacing material 504. As will be appreciated, applying the hardfacing material 504 to the depressions 502 may prove advantageous in increasing the abrasion, erosion, and/or corrosion resistance of the inner arcuate surface 308*a* of the retainer 206.

The hardfacing material 504 can be applied to the depressions 502 via a variety of hardfacing techniques including, but not limited to, oxyacetylene welding (OXY), atomic hydrogen welding (ATW), welding via tungsten inert gas (TIG), gas tungsten arc welding (GTAW), shielded metal arc welding (SMAW), gas metal arc welding (GMAW—including both gas-shielded and open arc welding), oxyfuel welding (OFW), submerged arc welding (SAW), electroslag welding (ESW), plasma transferred arc welding (PTAW—also called powder plasma welding), additive/subtractive manufacturing, thermal spraying, cold polymer compounds, laser cladding, hardpaint, and any combination thereof.

One suitable hardfacing material 504 comprises sintered tungsten carbide particles in a steel alloy matrix. The tungsten carbide particles may include grains of monotungsten carbide, ditungsten carbide and/or macrocrystalline tungsten carbide. Spherical cast tungsten carbide may typically be formed with no binding material. Examples of binding materials used to form tungsten carbide particles may include, but are not limited to, cobalt, nickel, boron, molybdenum, niobium, chromium, iron and alloys of these elements. Other hard constituent materials include cast or sintered carbides consisting of chromium, molybdenum, niobium, tantalum, titanium, vanadium and alloys and mixtures thereof.

In some embodiments, one or more of the depressions 502 may alternatively be used to retain and otherwise receive a bearing element 506. The bearing element 506 may comprise, for example, a TSP or another ultra-hard material secured within a corresponding depression 502, cast into the inner arcuate surface 308*a* of the retainer 206, or otherwise secured thereto. Although the bearing element 506 is illustrated as having a generally circular cross-section, it will be appreciated that the bearing element 506 may alternatively exhibit any suitable shape, such as oval, polygonal, etc., without departing from the scope of the disclosure. In at least one embodiment, the entire inner arcuate surface 308*a* of the retainer 206 may comprise the bearing element 506 or may otherwise be coated with an ultra-hard material that acts as a bearing element or bearing surface, without departing from the scope of the disclosure.

In FIG. 5B, the extraction feature 316 is depicted in the form of a groove or channel defined on the outer arcuate surface 308*b* of the retainer 206. In some embodiments, as illustrated, the extraction feature 316 extends the entire distance between the opposing sidewalls 406*a,b*. In other embodiments, however, the extraction feature 316 may only be provided at a localized or central location on the outer arcuate surface 308*b* between the sidewalls 406*a,b*. In yet other embodiments, the extraction feature 316 may comprise two or more structures, such as two laterally offset grooves, depressions, or the like.

In some embodiments, one or more material cavities 508 (two shown) may be defined or otherwise provided on the outer arcuate surface 308*b* of the retainer 206. The material cavities 508 may be used to retain a locking material (e.g., braze paste, solder, etc.) used to secure the retainer 206 within the cavity 202 (FIGS. 2 and 3). As will be appreciated, the material cavities 508 may prove advantageous in helping to maintain the locking material where it is needed for properly securing the retainer within the cavity 202. More specifically, as the retainer 206 is inserted (rotated) into the retainer slot 302 (FIG. 3), a portion of a locking material applied to the outer arcuate surface 308*b* to secure the retainer 206 to the cavity 202 may be scraped off. The material cavities 508, however, are inset into the outer arcuate surface 308*b* and are, therefore, able to retain an amount of the locking material. This retained locking material may then be used during a subsequent brazing or soldering process to properly secure the retainer 206 within the cavity 202.

Exemplary assembly of the rolling element assembly 200 in a blade 104 of a drill bit 100 (FIGS. 1A-1B) will now be discussed, according to one or more embodiments. FIG. 6A is an exploded side view of the rolling element assembly 200. The opening 216 to the cavity 202 defined in the blade 104 exhibits a dimension 602 (i.e., a length or width) that is larger than the circumference or diameter C of the rolling element 204. As a result, the rolling element 204 may be able to pass through the opening 216 to be received within the cavity 202. Once the rolling element 204 is seated within the cavity 202, the retainer 206 may be inserted into the cavity 202 and, more particularity, into the retainer slot 302.

Figure 6B:
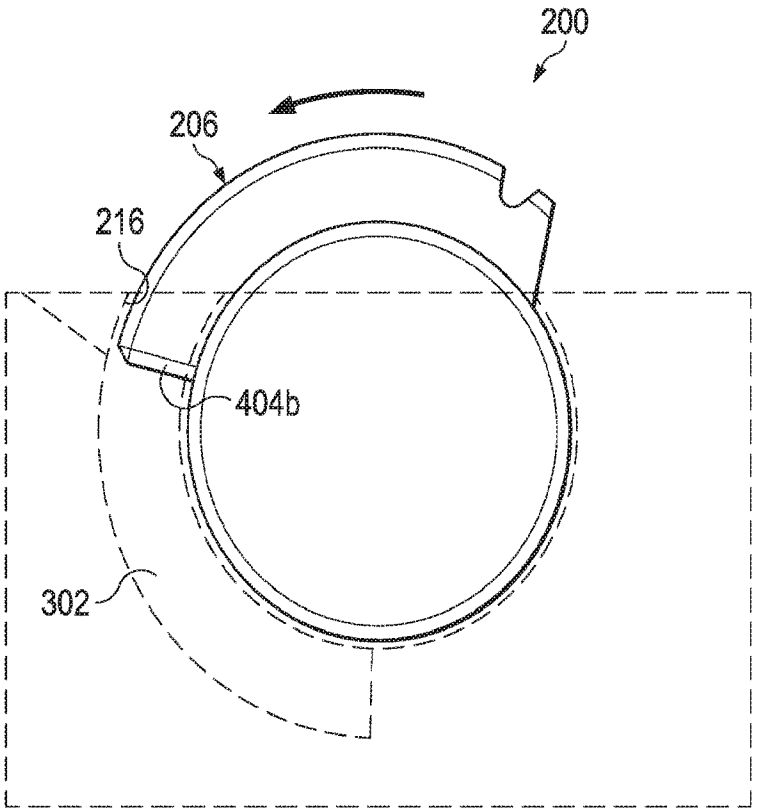
FIGS. 6B-6D are side views of the rolling element assembly of FIGS. 2 and 3 showing progressive installation of the retainer.
Figure 6A:
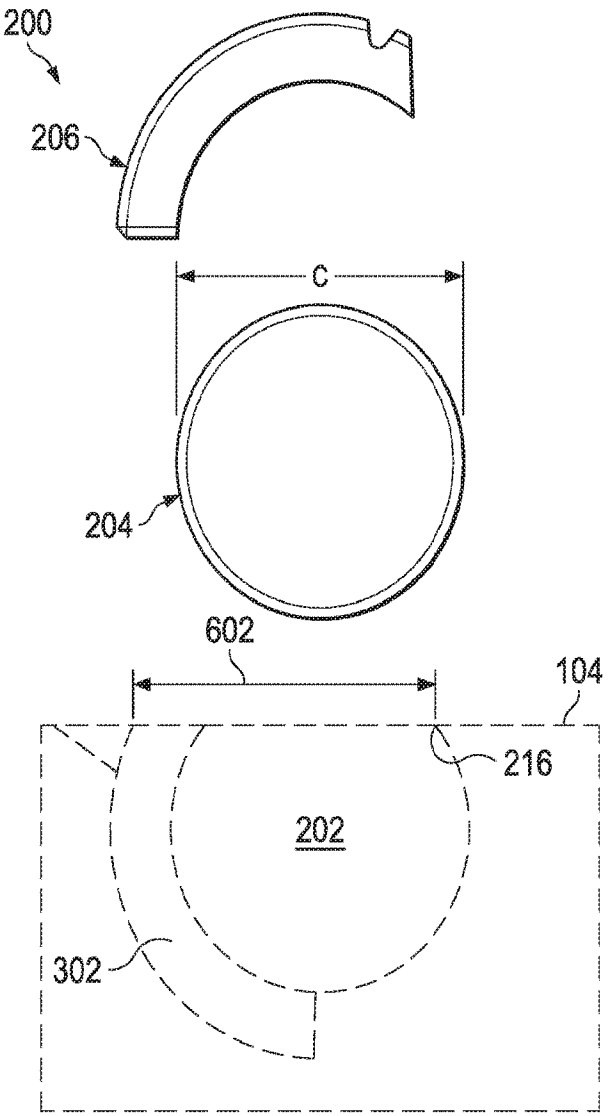
FIG. 6A is an exploded side view of the rolling element assembly of FIGS. 2 and 3.
Figure 6C:
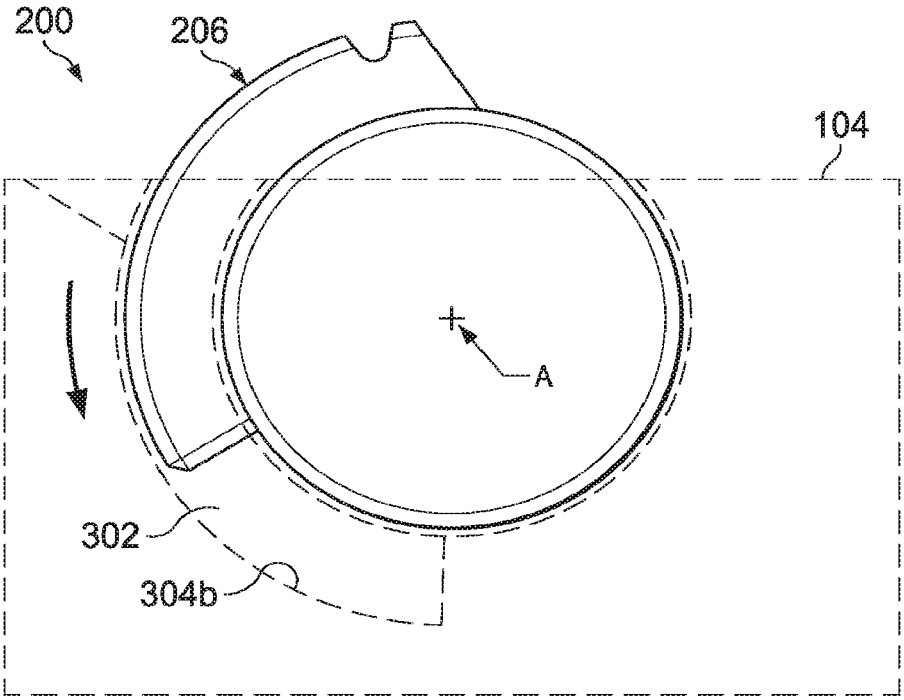
Figure 6D:
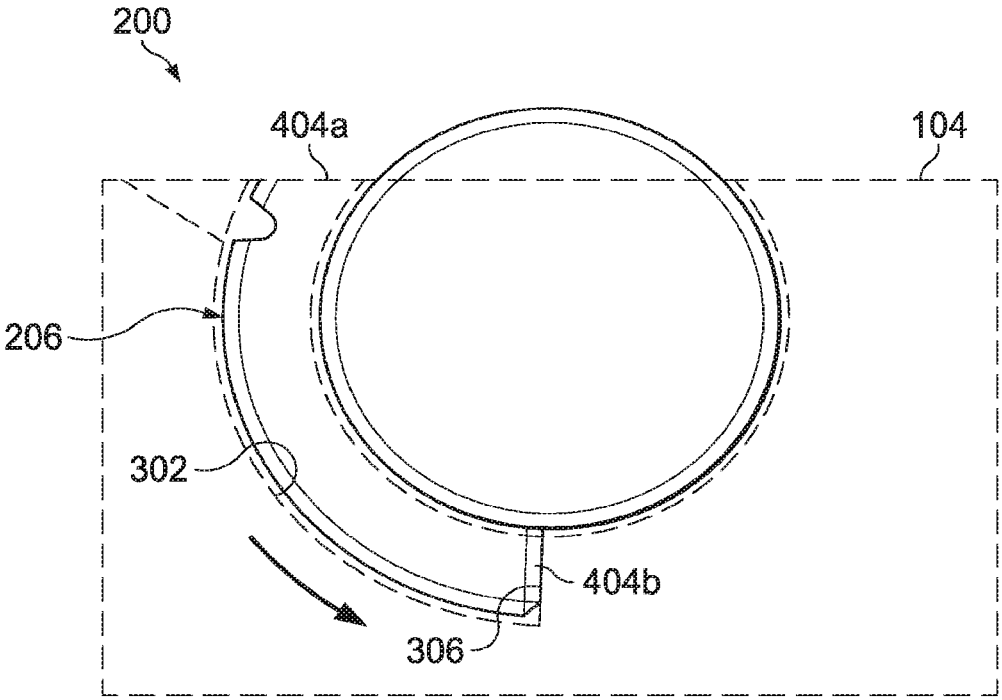

FIGS. 6B, 6C, and 6D are side views of the rolling element assembly 200 sequentially showing the retainer 206 being received within the retainer slot 302. In FIG. 6B, the second end 404*b* of the retainer 206 is depicted as having entered the retainer slot 302 via the opening 216.

In FIG. 6C, the retainer 206 is depicted as having advanced further into the retainer slot 302. This can be accomplished by rotating the retainer 206 about the rotational axis A and allowing the retainer 206 to slidingly engage the second arcuate portion 304*b* of the cavity 202.

In FIG. 6D, the retainer 206 is depicted as having advanced into the retainer slot 302 until the second end 404*b* has engaged or come into close contact with the end wall 306, at which point the cavity 202 and the retainer 206 cooperatively encircle more than 180° of the circumference of the rolling element 204, but less than 360° to retain the rolling element 204 within the cavity 202. In some embodiments, as illustrated, with the retainer 206 received within the retainer slot 302, the first end 404*a* may reside flush with the outer surface of the blade 104. In other embodiments, however, the first end 404*a* may be seated just below the outer surface of the blade 104. Once the retainer 206 has been extended into the retainer slot 302, as shown in FIG. 6D, the retainer 206 may be secured within the retainer slot 302 by any of the attachment means or techniques discussed herein.

Figure 7:
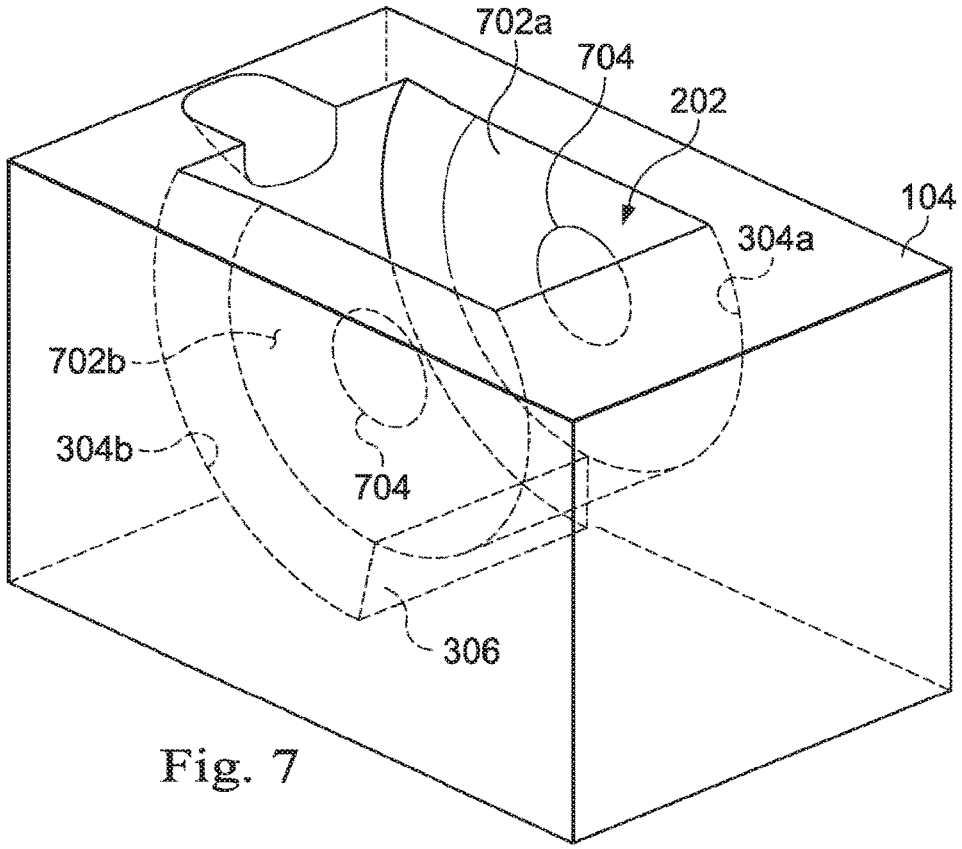
FIG. 7 is an isometric view of an example cavity defined in a blade of the drill bit of FIGS. 1A-1B.

FIG. 7 is an isometric view of an example cavity 202 defined in a blade 104 of the drill bit 100 of FIGS. 1A-1B. As illustrated, the cavity 202 includes the first and second arcuate portions 304*a,b* that help support the rolling element 204 (FIGS. 2 and 3) and the retainer 206 (FIGS. 2 and 3), respectively, and the end wall 306. The interior of the cavity 202 also provides and otherwise defines a first side surface 702*a* and a second side surface 702*b* opposite the first side surface 702*a* within the cavity 202. The side surfaces 702*a,b* may be engageable with the opposing diamond tables 214*a,b* (FIG. 2) of the rolling element 204 during operation. Accordingly, in at least one embodiment, the side surfaces 702*a,b* may be substantially parallel to the opposing diamond tables 214*a,b* when the rolling element 204 is installed in the cavity 202. During operation, both side surfaces 702*a,b* may or may not always engage or contact the opposing diamond tables 214*a,b*.

In some embodiments, the first and second side surfaces 702*a,b* may form integral parts of the blade 104 and, therefore, may be made of the same materials as the bit body 102 (FIG. 1A), e.g., a matrix composite material. In other embodiments, however, all or a portion of one or both of each side surface 702*a,b* may be made of tungsten carbide, steel, an engineering metal, a coated material (i.e., using processes such as chemical vapor deposition, plasma vapor deposition, etc.), or another hard or suitable abrasion resistant material.

In yet other embodiments, or in addition thereto, one or both of the side surfaces 702*a,b* may have a bearing element 704 positioned thereon to be engageable with an adjacent diamond table 214*a,b* of the rolling element 204. The bearing element 704 may comprise, for example, a TSP or another ultra-hard material cast into the particular side surface 702*a,b* or otherwise secured thereto. Although the bearing element 704 is illustrated as having a generally circular cross-section, it will be appreciated that the bearing element 704 may alternatively exhibit any suitable shape, such as oval, polygonal, etc., that may be engageable with the opposing diamond tables 214*a,b*, without departing from the scope of the disclosure. In at least one embodiment, the entire side surface 702*a,b* may comprise a bearing element 704 or may otherwise be coated with an ultra-hard material that acts as a bearing element or bearing surface, without departing from the scope of the disclosure.

FIGS. 8A-8F are top views of example cavities 202 defined in a blade 104 of the drill bit 100 of FIGS. 1A-1B, according to various embodiments. In each of FIGS. 8A-8F, the shape of the cavity 202 may vary at the retainer slot 302 to accommodate a particular retainer 206 (FIGS. 2 and 3). Any shape that restricts the retainer 206 from shifting from a defined radial position may be used. This may prove advantageous during assembly where exerted unintended pressure on the rolling element 204 may be avoided and a more defined cavity 202 may be result for the rolling element 204 to reside.

Figure 8A:
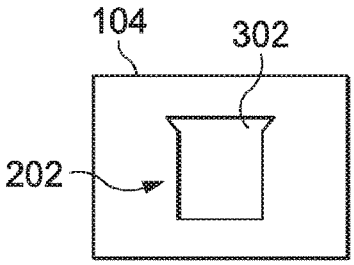
FIGS. 8A-8F are top views of example cavity designs as defined in a blade of the drill bit of FIGS. 1A-1B.
Figure 8B:
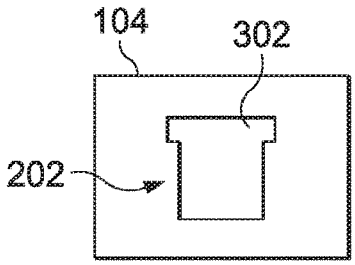
Figure 8C:
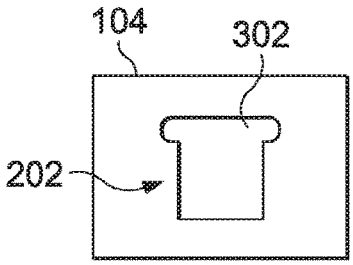

FIGS. 8A-8C depict generally symmetric shapes for the retainer slot 302. In FIG. 8A, the retainer slot 302 exhibits a generally dovetail shape. Accordingly, the cavity 202 of FIG. 8A may be configured to receive the retainer 206 shown in FIGS. 4A and 4B, which exhibits a dovetail cross-sectional shape. In FIG. 8B, the retainer slot 302 has squared-off ends. In FIG. 8C, the retainer slot 302 has rounded ends. It is noted that the dovetail shape of FIG. 8A and the T-shape of FIGS. 8B and 8C may be preferred in minimizing stress risers in the cavity 202.

Figure 8D:
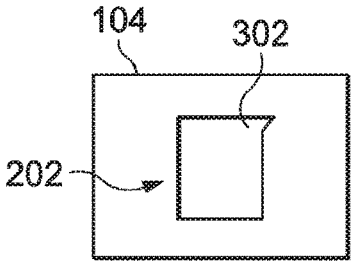
Figure 8E:
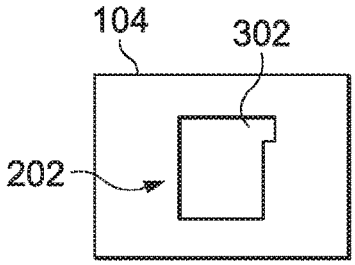
Figure 8F:
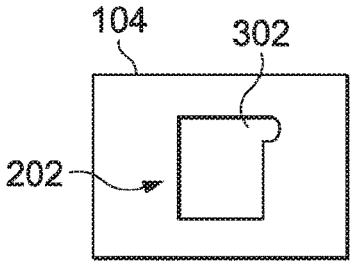

FIGS. 8D-8F depict generally asymmetric shapes for the retainer slot 302. In FIG. 8D, for example, only one end of the retainer slot 302 has an angled feature. In FIG. 8E, only one end of the retainer slot 302 is squared off. In FIG. 8F, only one end of the retainer slot 302 is rounded.

Those skilled in the art will readily appreciate that other designs and configurations of the cavity 202 and the retainer slot 302 may be employed. For instance, a combination of rounded and polygonal features may define the retainer slot 302, without departing from the scope of the disclosure.

Figure 9A:
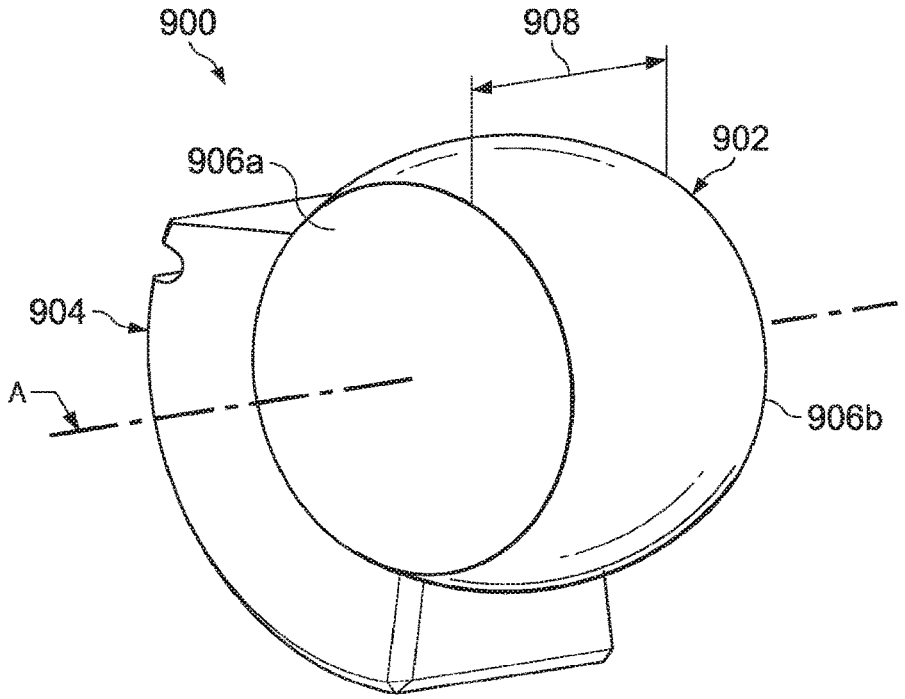
FIG. 9A is an isometric view of another example rolling element assembly.

FIG. 9A is an isometric view of another example rolling element assembly 900, according to one or more embodiments. Similar to the rolling element assembly 200 of FIGS. 2, 3, and 6A-6D, the rolling element assembly 900 may be used with the drill bit 100 of FIGS. 1A-1B, in which case the rolling assembly 900 may be a substitution for either of the rolling element assemblies 118*a,b* or a specific example embodiment of the rolling element assemblies 118*a,b*. Moreover, the rolling element assembly 900 may also be secured within a cavity defined in a blade 104 (FIGS. 1A-1B) of the drill bit 100.

As illustrated, the rolling element assembly 900 includes a rolling element 902 and a retainer 904 used to help retain the rolling element 902 within a cavity. The rolling element 902 comprises a generally cylindrical body having a first axial end 906*a* and a second axial end 906*b* opposite the first axial end 906*a*. While not specifically shown, in some embodiments, diamond tables (i.e., diamond tables 214*a* and 214*b* of FIGS. 2 and 3) may be positioned at the opposing first and second axial ends 906*a,b*. In other embodiments, the entire cylindrical body of the rolling element 902 may be made of a monolithic hard or ultra-hard material.

Unlike the rolling element 204 of FIGS. 2 and 3, the rolling element 902 may exhibit a variable diameter between the first and second axial ends 906*a,b* and along the axial width 908. More specifically, the circumference of the rolling element 902 may be curved, rounded, or otherwise arcuate as extending between the opposing first and second axial ends 906*a,b* along the axial width 908 of the rolling element 902. Accordingly, the diameter of the rolling element 902 may be greatest at a center point between the opposing first and second axial ends 906*a,b*, or alternatively at another point between the opposing first and second axial ends 906*a,b*.

Figure 9B:
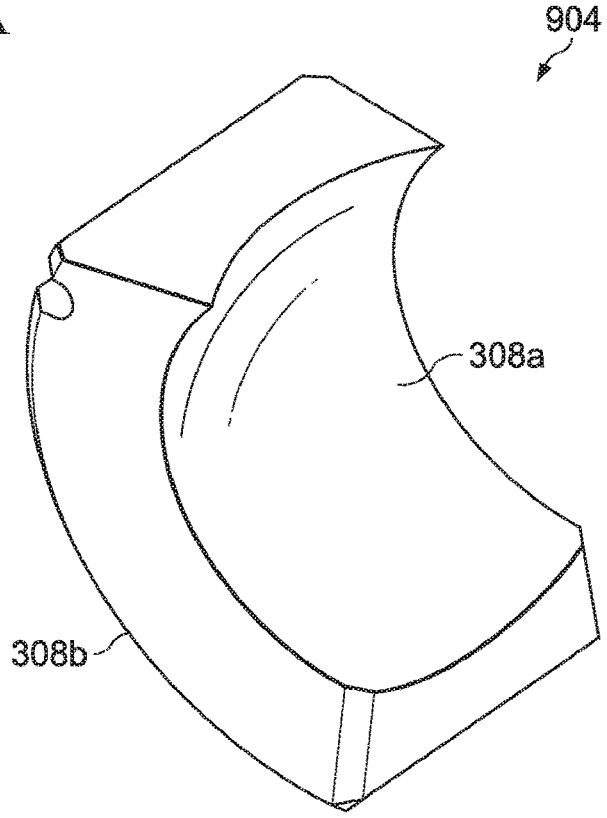
FIG. 9B is an isometric view of the retainer of the rolling element assembly of FIG. 9A.

FIG. 9B is an isometric view of the retainer 904 of the rolling element assembly 900 of FIG. 9A. The retainer 904 may be similar in some respects to the retainer 206 of FIGS. 2 and 3, such as being made out of similar materials, having the inner and outer arcuate surfaces 308*a,b*, etc. Unlike the retainer 206, however, the inner arcuate surface 308*a* is curved, rounded, and otherwise exhibits a concave shape configured to receive the rolling element 902 (FIG. 9A) of the rolling element assembly 900. During drilling operations, the rolling element 902 is able to rotate about a rotational axis A (FIG. 9A) of the rolling element 902 and slidingly engage the inner arcuate surface 308*a* of the retainer 904.

While the rolling element 902 and the retainer 904 are depicted in FIGS. 9A and 9B as having generally curved surfaces, those skilled in the art will readily appreciate that the rolling element 902 and the retainer 904 may alternatively exhibit other mating shapes, without departing from the scope of the disclosure.

Figure 10A:
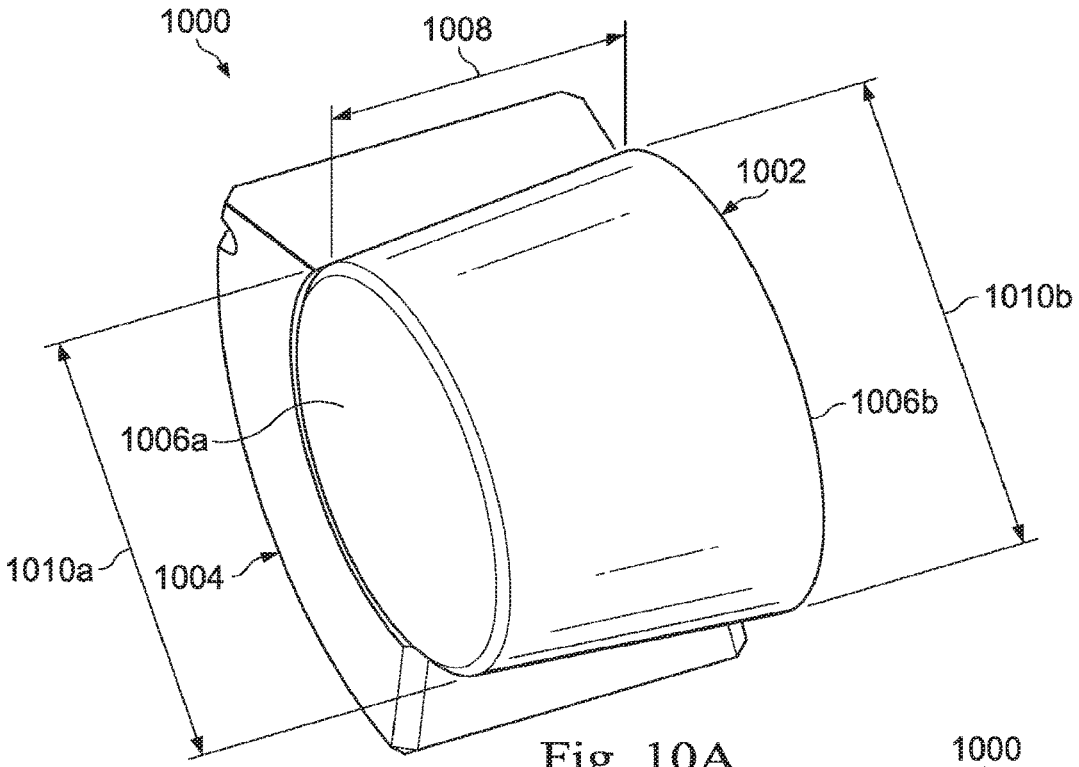
FIG. 10A is an isometric view of another example rolling element assembly.

FIG. 10A is an isometric view of another example rolling element assembly 1000, according to one or more embodiments. Similar to the rolling element assembly 200 of FIGS. 2, 3, and 6A-6D, the rolling element assembly 1000 may be used with the drill bit 100 of FIGS. 1A-1B, in which case the rolling assembly 1000 may be a substitution for either of the rolling element assemblies 118*a,b* or a specific example embodiment of the rolling element assemblies 118*a,b*. Moreover, the rolling element assembly 1000 may also be secured within a cavity defined in a blade 104 (FIGS. 1A-1B) of the drill bit 100.

As illustrated, the rolling element assembly 1000 includes a rolling element 1002 and a retainer 1004 used to help retain the rolling element 1002 within a cavity. The rolling element 1002 comprises a generally cylindrical body having a first axial end 1006*a* and a second axial end 1006*b* opposite the first axial end 1006*a*. While not specifically shown, in some embodiments, diamond tables (i.e., diamond tables 214*a* and 214*b* of FIGS. 2 and 3) may be positioned at the opposing first and second axial ends 1006*a,b*. In other embodiments, the entire cylindrical body of the rolling element 1002 may be made of a monolithic hard or ultra-hard material.

Similar to the rolling element 902 of FIG. 9A, the rolling element 1002 may exhibit a variable diameter between the first and second axial ends 1006*a,b* along the axial width 1008 of the rolling element 1002. More specifically, the diameter of the rolling element 900 may gradually increase or decrease (linearly or non-linearly) along the axial width 1008 of the rolling element 1002. As depicted, the first axial end 1006*a* exhibits a first diameter 1010*a* and the second axial end 1006*b* exhibits a second diameter 1010*b*, where the second diameter 1010*b* is greater than the first diameter 1010*a*. Accordingly, in at least one embodiment, the rolling element 1002 may be characterized as a generally frustoconical element.

Figure 10B:
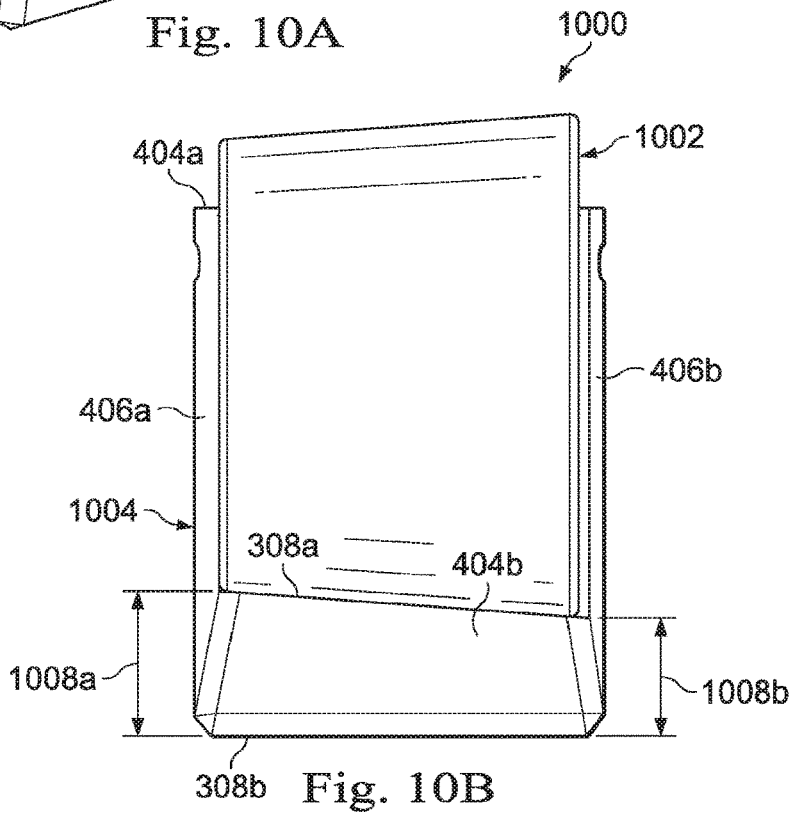
FIG. 10B is an end view of the rolling element assembly of FIG. 10A.

FIG. 10B is an end view of the rolling element assembly 900. The retainer 1004 may be similar in some respects to the retainer 206 of FIGS. 2 and 3, such as being made out of similar materials, having the inner and outer arcuate surfaces 308*a,b*, having the first and second ends 404*a,b*, and having the first and second sidewalls 406*a, b* that extend radially between the inner and outer arcuate surfaces 308*a,b* on each axial end of the retainer 1004. Unlike the retainer 206 of FIGS. 2 and 3, however, the body of the retainer 1004 is shaped to receive the frustoconical-shaped rolling element 1002 and, therefore, exhibits a polygonally asymmetric cross-sectional shape. More specifically, the body of the retainer 1004 exhibits a first thickness or depth 1008*a* at the first sidewall 406*a* and exhibits a second thickness or depth 1008*b* at the second sidewall 406*b*, where the first and second depths 1008*a,b* are different. In the illustrated, embodiment, the first depth 1008*a* is greater than the second depth 1008*b*, but the second depth 1008*b* could alternatively be greater than the first depth 1008*a*, without departing from the scope of the disclosure.

Figure 11A:
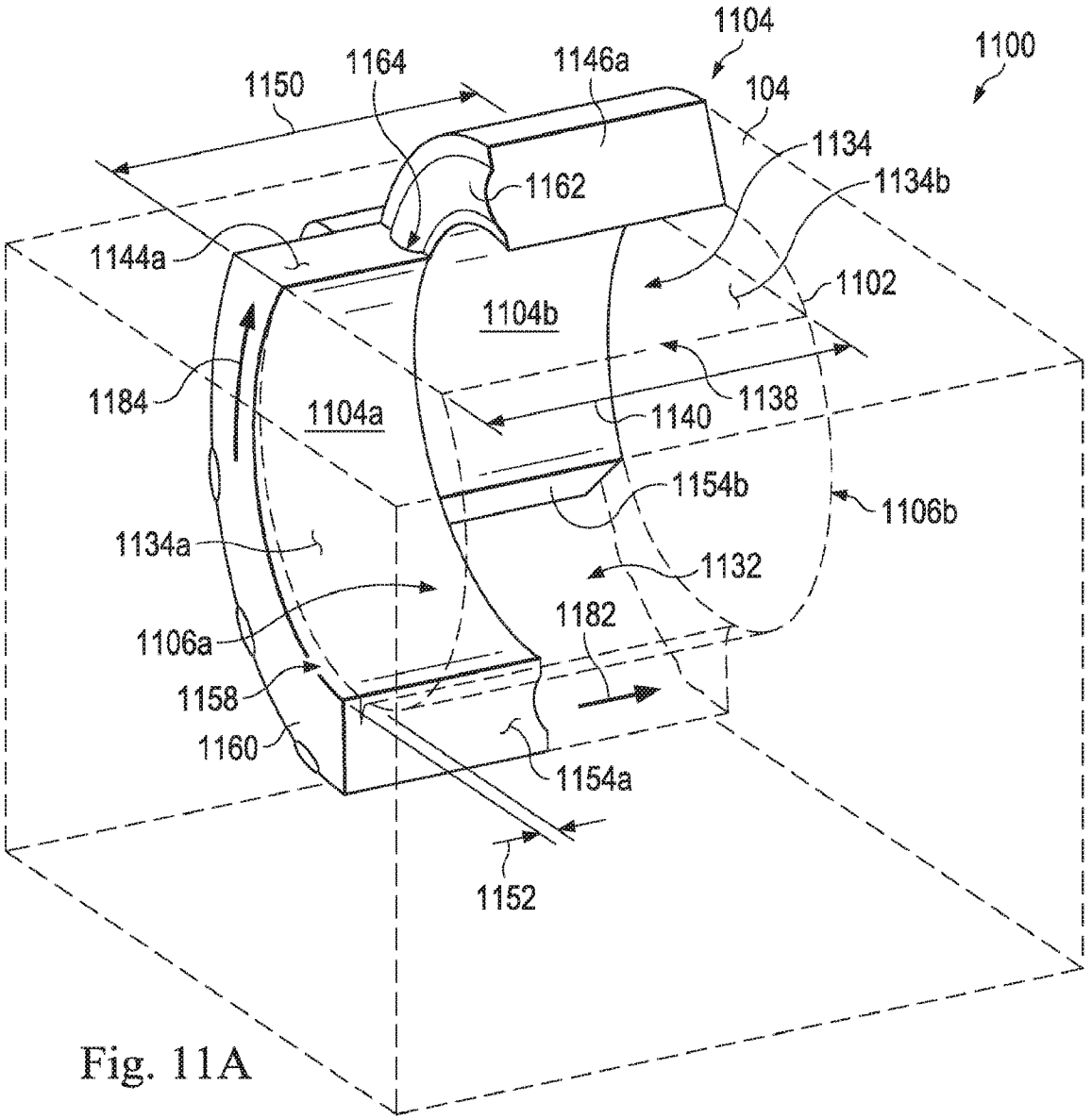
FIG. 11A is an isometric view of another example rolling element assembly including a two-piece wedge lock retainer with a first retainer piece disposed fully within a retainer slot and a second retainer piece partially disposed within the retainer slot.

FIG. 11A is an isometric view of another example rolling element assembly 1100, according to one or more embodiments. Similar to the rolling element assembly 200 of FIGS. 2, 3, and 6A-6D, the rolling element assembly 1100 may be used with the drill bit 100 of FIGS. 1A-1B, in which case the rolling element assembly 1100 may be a substitution for either of the rolling element assemblies 118*a,b* or a specific example embodiment of the rolling element assemblies 118*a,b*. Moreover, the rolling element assembly 1100 may also be secured within a cavity defined in a blade 104 (FIGS. 1A-1B) of the drill bit 100.

As illustrated, the rolling element assembly 1100 includes a rolling element 1102 and a two-piece retainer 1104 used to help retain the rolling element 1102 within a cavity. The rolling element 1102 is illustrated in dashed linetype as comprising a generally cylindrical body having a first axial end 1106*a* and a second axial end 1106*b* opposite the first axial end 1106*a*. The rolling element 1102 is illustrated with a constant diameter between the first and second axial ends 1106*a,b*, and in other embodiments, the rolling element may exhibit a variable diameter as illustrated, e.g. in 9A-10B. While not specifically shown, in some embodiments, diamond tables (i.e., diamond tables 214*a* and 214*b* of FIGS. 2 and 3) may be positioned at the opposing first and second axial ends 1106*a,b*. In other embodiments, the entire cylindrical body of the rolling element 1002 may be made of a monolithic hard or ultra-hard material.

Figure 11B:
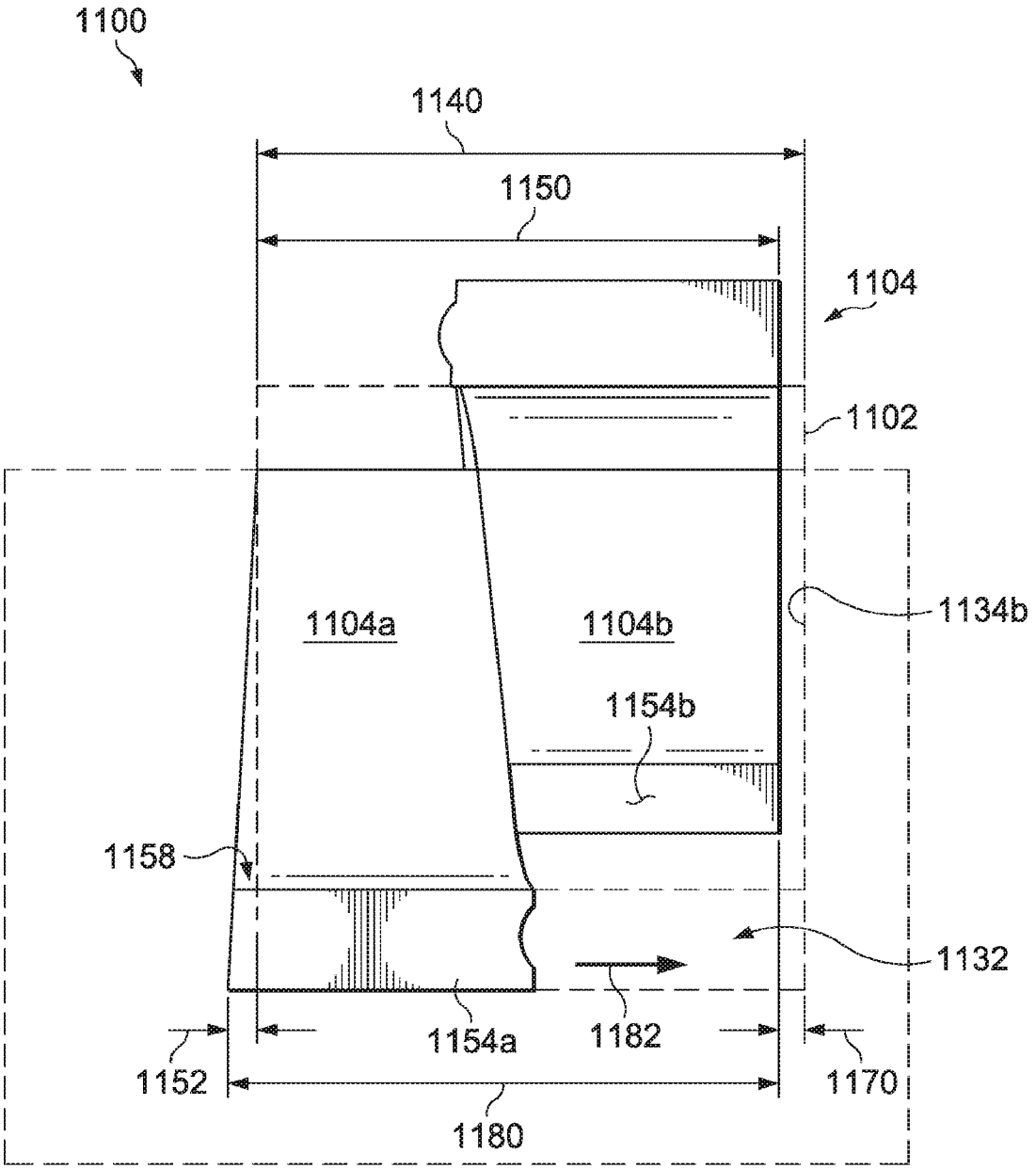
FIGS. 11B and 11C are end views of the rolling element assembly of FIG. 11A with the second retainer piece partially disposed within the retainer slot and fully within the retainer slot, respectively.

The two-piece retainer 1104 includes a first retainer piece 1104*a* and a second retainer piece 1104*b* disposed within a retainer slot 1132 defined within a cavity 1134 of blade 104. The interior of the cavity 1134 also provides and otherwise defines a first side surface 1134*a* and a second side surface 1134*b* opposite the first side surface 1134*a* within the cavity 1134. As illustrated, the side surfaces 1134*a,b* may be substantially parallel to the opposing second axial ends 1106*a,b* of the rolling element 1102 when the rolling element 1102 is installed in the cavity 1134. An opening 1138 to the cavity 1134 defines an axial width 1140 thereacross, which, in the illustrated embodiment, extends over the retainer slot 1132. During operation, the rolling element 1102 may or may not extend across the axial width 1140 such that the first and second axial ends 1106*a,b* of the rolling element 1102 may or may not always engage or contact the opposing side surfaces 1134*a,b* of the cavity 1134. Respective first ends 1144*a* 1146*a* of the first and second retainer pieces 1104*a*, 1104*b* together define an axial width 1150 of the two-piece retainer 1104. Due to an axial taper in one or both of the retainer pieces 1104*a,b*, the axial width 1150 changes as the second retainer piece 1104*b* is rotated into the retainer slot 1132. For example, an axial taper is provided on a helically shaped side of the second retainer piece 1104*b* that engages the first retainer piece 1104*a*. Thus, in the configuration illustrated, with the second retainer piece 1104*b* partially inserted into the retainer slot 1132 (as illustrated in FIGS. 11A and 11B), the axial width 1150 is substantially less than the axial width 1140 of the opening 1138. When the second retainer piece 1104*b* is fully inserted (see FIG. 11C), the axial with 1150 may be substantially similar to the axial width 1140 or greater than the axial width 1140 such that an interference fit is established between the two piece retainer 1104 and the blade 104.

The retainer slot 1132 includes an optional axial offset 1152 with respect to the side surface 1134*a* and the opening 1138. The axial offset 1152 permits a second end 1154*a* of the first retainer piece 1104*a* within the retainer slot 1132 to be axially offset from the first end 1144*a* of the first retainer piece 1104*a*. As illustrated, the axial offset 1152 is formed from an offset region 1158 of the retainer slot 1132 that extends helically from the side surface 1134*a* and receives a correspondingly-shaped protruding portion 1160 of the first retainer piece 1104*a*. In other embodiments, an axial offset may include a notch, slot or keyhole shaped to receive a correspondingly shaped protrusion of a first retainer piece therein. With the protruding portion 1160 extending into the offset region 1158 of the retainer slot 1132, the retainer slot 1132 may receive the second retainer piece 1104*b* therein. The second retainer piece 1104*b* optionally includes a helical ridge 1162 defined on an axial side thereof. The helical ridge 1162 is arranged to engage and interlock with a helical groove 1164 defined on an axial side of the first retainer piece. The helical ridge 1162 may guide the second retainer piece 1104*b* into the proper position within the retainer slot 1132. Installation of the second retainer piece 1104*b* into the retainer slot 1132 prohibits axial withdrawal of the protruding portion 1160 of the first retainer piece 1104*a* from the offset region 1158 of the retainer slot 1132.

Figure 11C:
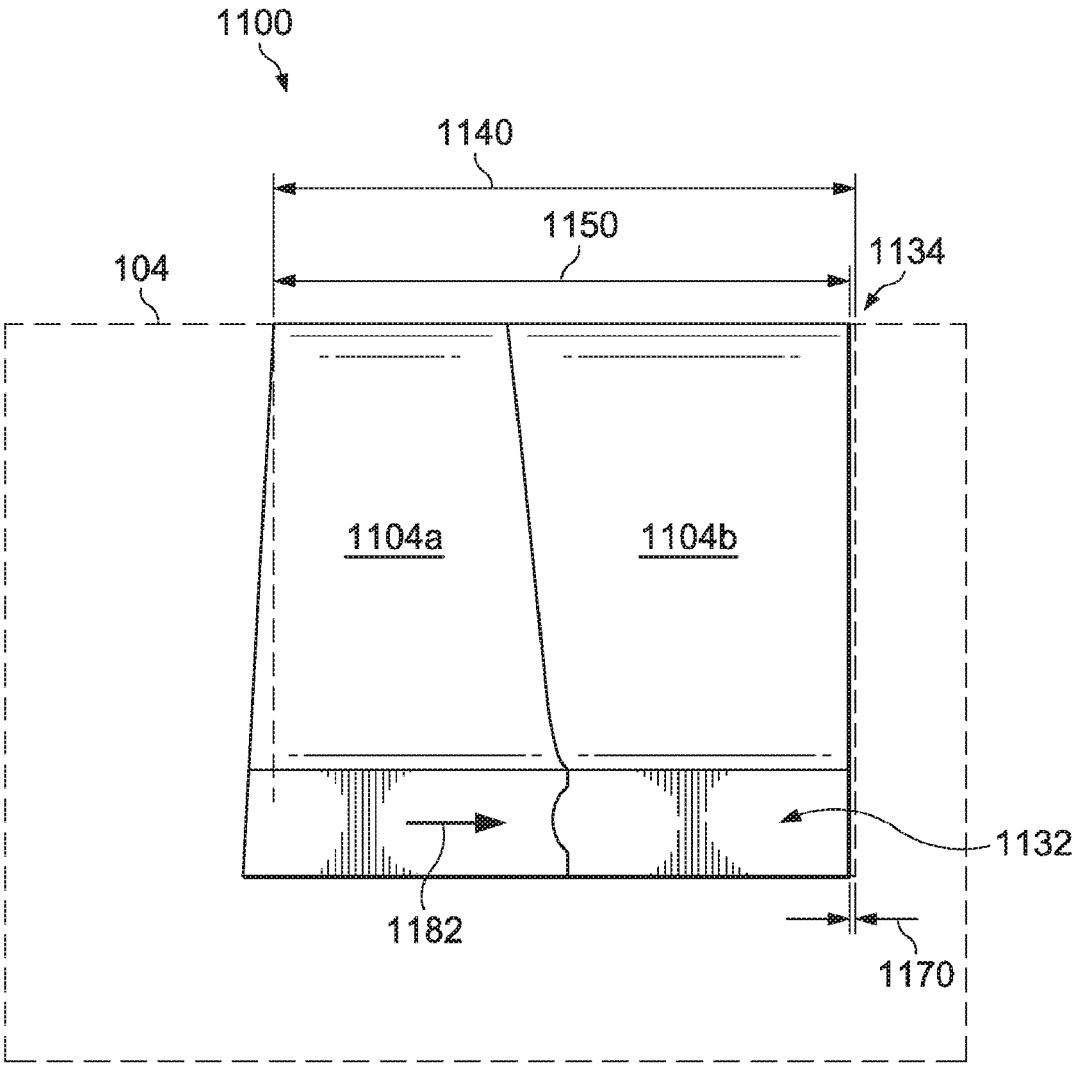

FIGS. 11B and 11C are end views of the rolling element assembly 1100. FIG. 11B illustrates the rolling element assembly 1100 with the second retainer piece 1104*b* in a partially inserted configuration. A clearance 1170 is defined between the second retainer piece 1104*b* and the second side surface 1134*b* of the cavity 1134. Due to tapered shape of the first and second retainer pieces 1104*a*, 1104*b*, the second retainer piece 1104*b* is urged axially toward the second side surface 1134*b* as it is inserted into the retainer slot 1132. FIG. 11C illustrates the rolling element assembly 1100 with the second retainer piece 1104*b* in a fully inserted configuration. In the illustrated embodiment, the clearance 1170 is eliminated since the axial width 1150 of the retainer is 1104 is substantially similar or slightly greater than the axial width 1140 of the cavity 1134. An interference fit is thus established between the two-piece retainer 1104 and the blade 104, and the retainer 1104 is wedged into the retainer slot 1132. Axial movement of the first and second retainer pieces 1104*a,b* in the direction of arrow 1182 is prohibited. Once wedged, the two retainer pieces 1104*a,b* are secured in the retainer slot 1132, thereby securing the rolling element 1102 (FIG. 11A) within the cavity 1134.

In other embodiments, some clearance 1170 may be maintained where the axial width 1150 of the retainer is less than the axial width 1140 of the cavity 1134. Where the clearance 1170 is less than the axial offset 1152, the protruding portion 1160 will extend at least a partially into the offset portion 1158 of the retainer slot 1132 even when the first and second retainer pieces 1104*a,b* are shifted axially in the direction of arrow 1182 toward the second side surface 1134*b*. The protruding portion 1160 thereby helps to retain the two-piece retainer 1104 within the retainer slot 1132 at least by preventing simultaneous removal of the first and second retainer pieces 1104*a,b* from the retainer slot 1132. For example, embodiments are contemplated in which the first and second retainer pieces 1104*a,b* may be functionally joined to one another (by friction, ratchet mechanism, a third retainer piece (see FIG. 14) etc.) once inserted into the retainer slot 1132, such that the two retainer pieces 1104*a,b* move circumferentially together. The protruding portion 1160 could then cause the two-piece retainer 1140 to become wedged in the retainer slot 1132 upon simultaneous movement of the two retainer pieces 1104*a,b* out of the retainer slot 1132, even when some clearance 1170 is maintained.

In some embodiments, an axial width 1180 defined by the second ends 1154*a,b* of the first and second retainer pieces 1104*a*, 1104*b* is greater than the axial width 1140 defined by the opening 1138 of the cavity 1134. In these embodiments, the first and second retainer pieces 1104*a*, 1104*b* may not be removed simultaneously from the retainer slot 1132. To remove the two-piece retainer 1104 from the retainer slot, the second retainer piece 1104*b* may first be moved in a circumferential direction 1184 (FIG. 11A) out of the retainer slot 1132. In some embodiments, removing the second retainer piece 1104*b* requires overcoming the interference fit established between the two-piece retainer 1104 and the blade 104. With the second retainer piece 1104*b* removed, the retainer slot 1132 and the opening 1138 then provide sufficient clearance for the first retainer piece 1104*a* to be moved in the axial direction 1182 (FIG. 11A) such that the protruding portion 1160 is removed from the offset region 1158 of the retainer slot 1132. The first retainer piece 1104*a* may sequentially or simultaneously be moved in the circumferential direction 1182 to thereby remove the first retainer piece 1104*a* from the retainer slot 1132. At least since the first and second retainer pieces 1104*a,b* are required to move in two directions 1182, 1184 for removal, the likelihood that the retainer 1104 will inadvertently escape the retainer slot 1132, e.g., due to operation loads, is reduced.

Figure 12:
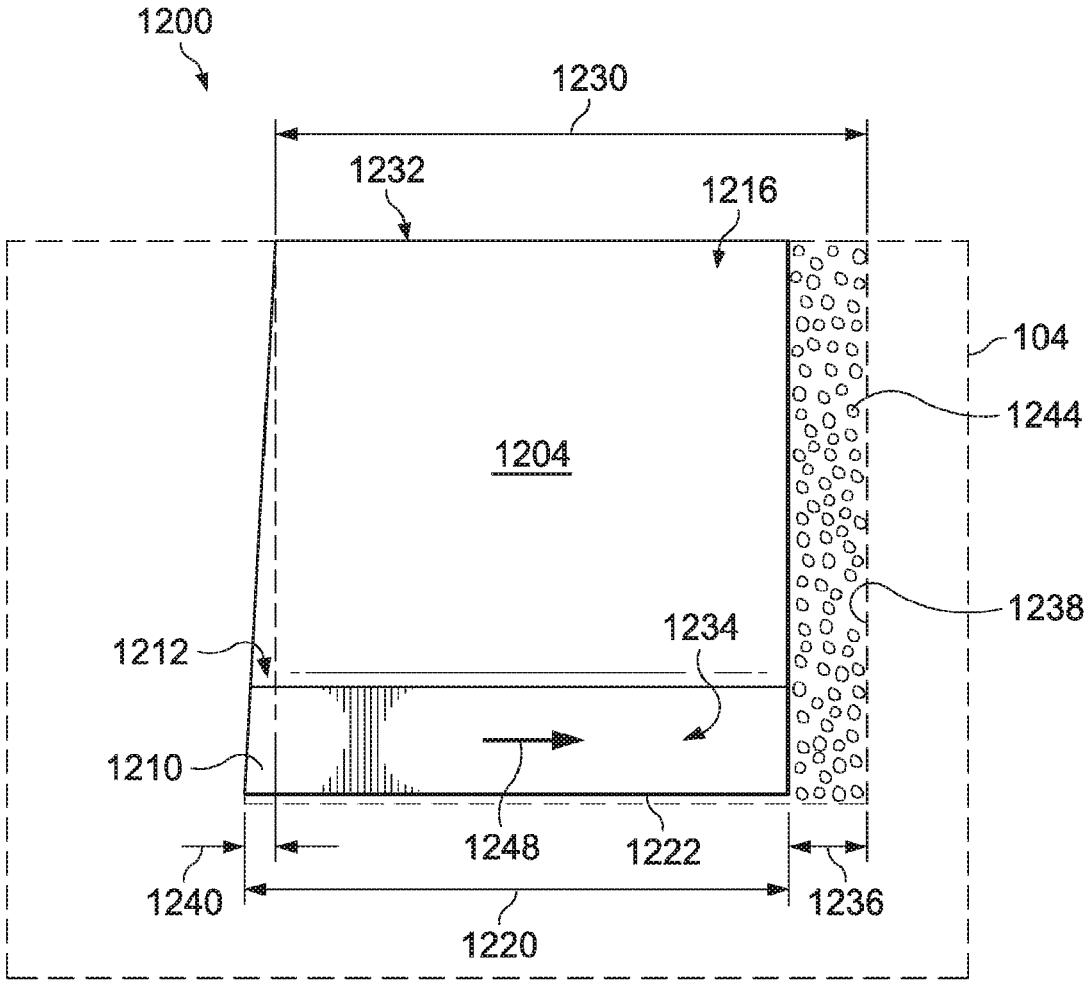
FIGS. 12-14 are end views of other example rolling element assemblies where a wedge lock retainer includes an axial offset.

FIG. 12 is an end view of an example rolling element assembly 1200 including a single-piece wedge lock retainer 1204. The retainer 1204 may be substantially similar to the first retainer piece 1104*a* (FIG. 11B) described above. As illustrated, the retainer 1204 lacks the helical groove 1164 of the first retainer piece 1104*a*, but is otherwise similar including a protruding portion 1210 that extends axially into an offset region 1212 of a cavity 1216 defined in blade 104. An axial width 1220 of lower end 1222 of the retainer 1204 may be less than an axial width 1230 defined at an opening 1232 of the cavity 1216. Thus, the retainer 1204 may be inserted through the opening 1232 and installed within a retainer slot 1234 of the cavity 1216 to define a clearance 1236 between the retainer 1204 and a sidewall 1238 of the cavity 1216. In some embodiments, the clearance 1236 may be greater than an axial offset 1240 defined by the protruding portion 1210 and an offset region 1212.

The clearance 1236 in the retainer slot 1234 may be filled with a biasing material 1244, such as a braze material, an epoxy or other filler to prohibit movement of the retainer 1204 in a lateral direction 1248. In this manner, the retainer 1204 may be maintained in the retainer slot 1234 with the protruding portion 1210 and an offset region 1212 of the cavity 1216. When it is necessary to remove the retainer 1204, the biasing material 1244 may be removed from the retainer slot 1234 (by melting the braze material, drilling or otherwise mechanically removing the filler). Thereafter, the retainer 1204 may be moved in the axial direction 1248 to permit removal of the retainer 1204 from the retainer slot 1234, e.g. in a circumferential direction as described above.

Figure 13:
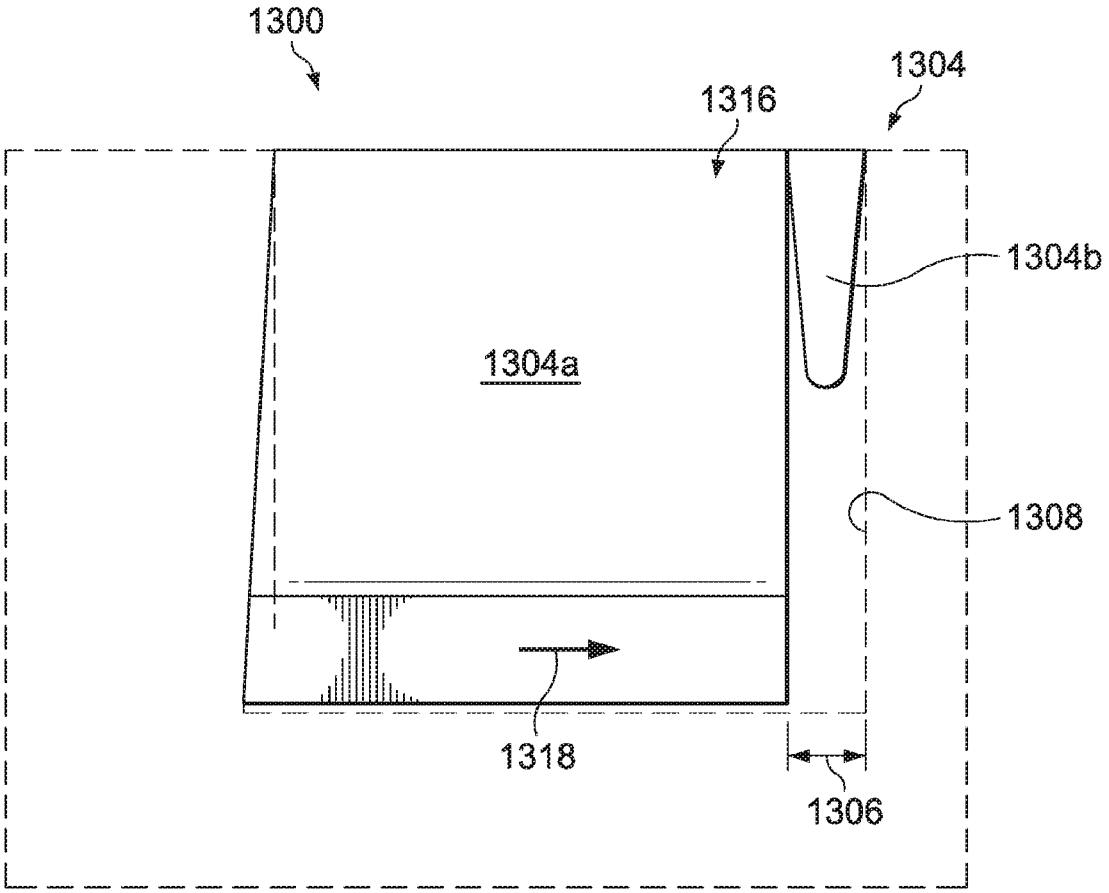

FIG. 13 is an end view of an example rolling element assembly 1300 including a two-piece wedge lock retainer 1304. The retainer 1304 includes a first retainer piece 1304*a*, and a second retainer piece 1304*b*, which may be a mechanical fastener or a biasing member. The first retainer piece 1304*a* may be substantially similar to the retainer 1204 (FIG. 12) described above, and a clearance 1306 may be defined between the first retainer piece 1304*a* and a sidewall 1308 of the cavity 1316. The second retainer piece 1304*b* may be wedged between the first retainer piece 1304*a* and the sidewall 1308 to prohibit axial movement of the first retainer piece 1304*a* in an axial direction 1318. In some embodiments, the second retainer piece 1304*b* is a mechanical fastener such as a rivet or a pin driven into the clearance 1306. In other embodiments, the second retainer piece 1304*b* may include a deformable spring or other biasing member positioned within the clearance to bias the first retainer piece 1304*a* in a direction opposite axial direction 1318.

Figure 14:
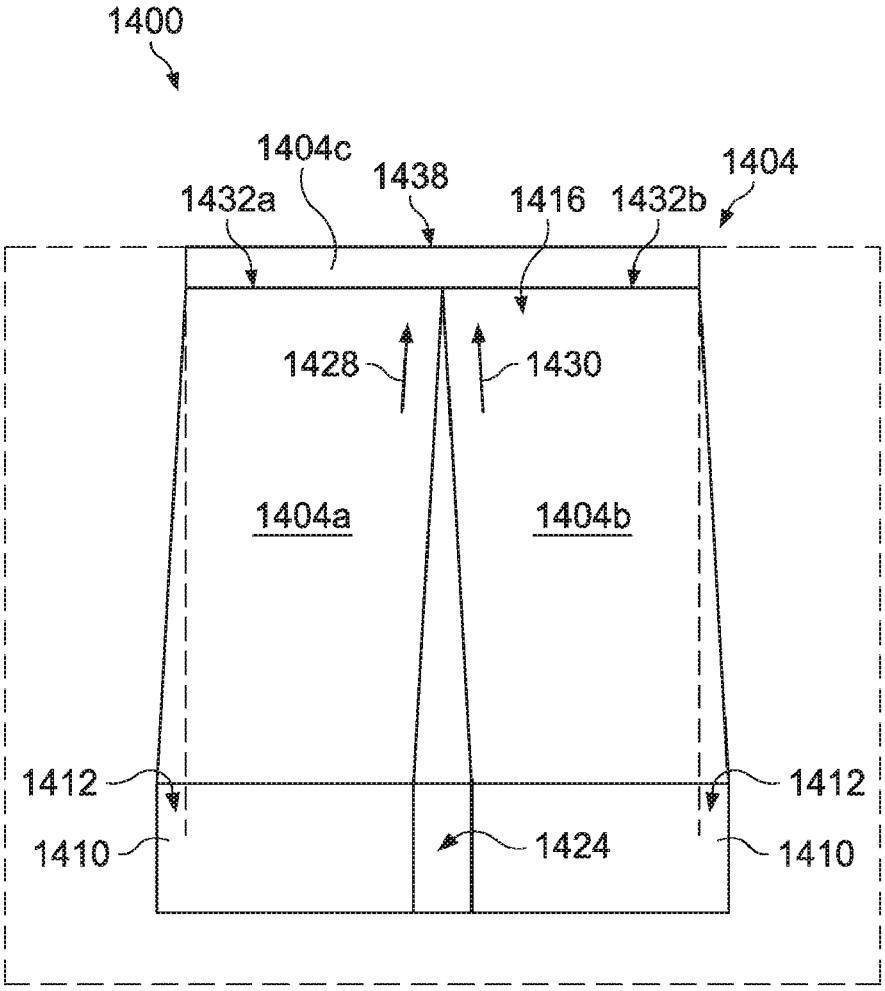

FIG. 14 is an end view of an example rolling element assembly 1400 including a three-piece wedge lock retainer 1404. The three-piece retainer 1404 includes first and second retainer pieces 1404*a,b*, and a third retainer piece 1404*c*. The first and second retainer pieces 1404*a* and 1404*b* may be mirror image parts with respect to one another, and each may include including a protruding portion 1410 extending into respective offset region 1412 of a cavity 1416. The first and second retainer pieces 1404*a,b* may be sequentially inserted into a retainer slot 1424. Each of the first and second retainer pieces 1404*a,b* may be individually extracted from the retainer slot 1424, e.g. in circumferential/axial directions 1428, 1430, but are arranged to interfere with one another to prohibit simultaneous extraction. The third retainer piece 1404*c* may couple upper ends 1432*a,b* of the first and second retainer pieces 1404*a,b* to one another such that the first and second retainer pieces 1404*a,b* may not be moved individually. The third retainer piece 1404*c* may be disposed at or near an opening 1438 of the cavity 1416 such that the third retainer piece 1404*c* may be applied subsequent to inserting the first and second retainer pieces 1404*a,b* into the retainer slot 1424 and may be readily removed to permit separation and removal of the first and second retainer pieces 1404*a,b*. In some embodiments, the third retainer piece 1404*c* may be secured to the upper ends 1432*a,b* of the first and second retainer pieces by a suitable epoxy, braze material, mechanical fasteners or other fastening mechanisms.

Figure 15:
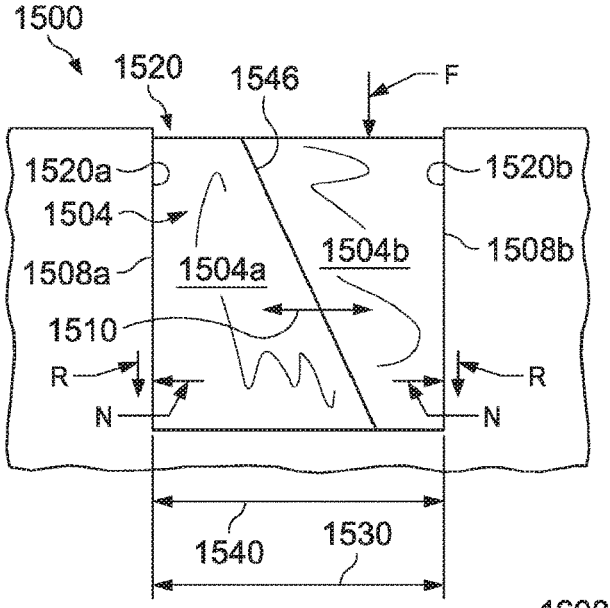
FIGS. 15-18 are end views of other example rolling element assemblies where wedge lock retainers establish an interference-fit with side walls of a retainer slot.

FIG. 15 is an end view of an example rolling element assembly 1500 including a two-piece wedge lock retainer 1504. The retainer 1504 includes first and second retainer pieces 1504*a,b* with parallel side walls 1508*a,b*. The side walls 1508*a,b* are substantially orthogonal to an axial direction 1510 of a rolling element (not shown) that may be retained by the retainer 1504. A retainer slot 1520 includes sidewalls 1520*a,b* that are also parallel and substantially orthogonal to the axial direction 1510. An axial width 1530 of the retainer 1504 is substantially similar or greater than an axial width 1540 of the retainer slot 1520 such that an interference fit is established between the retainer 1504 and the retainer slot 1520. The second retainer piece 1504*b* may be inserted into the retainer slot 1520 with a circumferential force "F" such that a tapered interface 1546 between the first and second retainer pieces 1504*a,b* creates a normal force "N" against parallel walls 1520*a,b* of the retainer slot 1520. The normal force "N," in turn, generates a frictional force "R" that resists removal of the retainer 1504 from the retainer slot.

Figure 16:
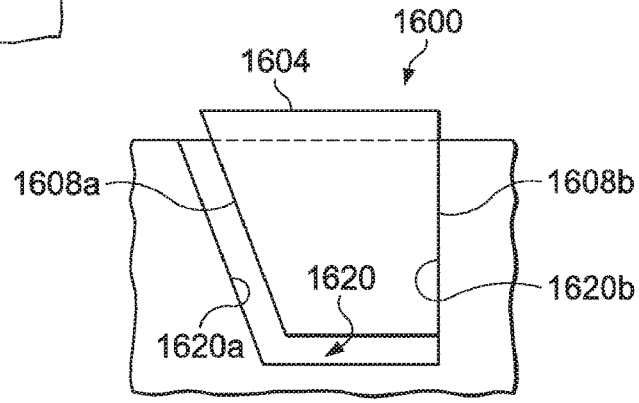

FIG. 16 is an end view of an example rolling element assembly 1600 including a single-piece wedge lock retainer 1604. The retainer 1604 includes opposing sides 1608*a,b* adjacent respective corresponding sidewalls 1620*a,b* of a retainer slot 1620. Side 1608*b* and corresponding sidewall 1620*b* are substantially parallel to one another and substantially orthogonal to an axial direction 1510 (FIG. 15). Side 1608*a* and corresponding sidewall 1620*b* are substantially parallel to one another and tapered in an axial direction, e.g., a circumferential direction, with respect to the axial direction 1510. An axial width of at least a portion of the retainer

1604 is substantially equal to or greater than an axial width of the retainer slot 1620 at a corresponding depth when the retainer 1604 is fully inserted into the retainer slot 1620. Thus, the retainer 1604 may be wedged into the retainer slot 1620 such that the retainer 1604 frictionally resists withdrawal from the retainer slot 1620.

Figure 17:
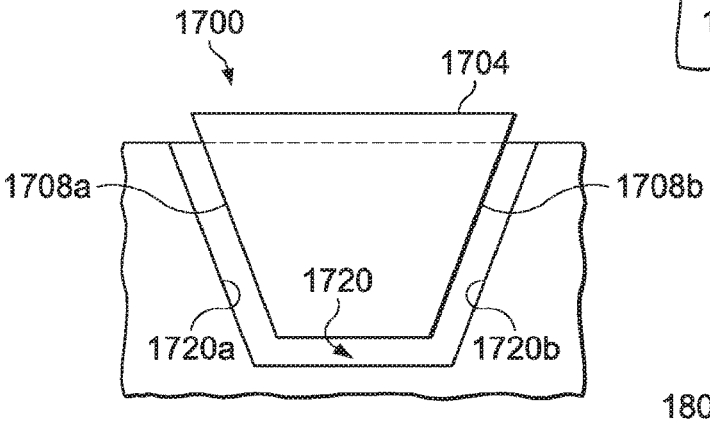

FIG. 17 is an end view of an example rolling element assembly 1700 including a single-piece wedge lock retainer 1704. The retainer 1704 includes opposing sides 1708*a,b* adjacent respective corresponding sidewalls 1720*a,b* of a retainer slot 1720. Both sides 1708*a,b* and both corresponding sidewalls 1720*a,b* are tapered with respect to the axial direction 1510 (FIG. 15) facilitating insertion of the retainer 1704 into the retainer slot 1720. An axial width of at least a portion of the retainer 1704 is substantially equal to or greater than an axial width of the retainer slot 1720 at a corresponding depth when the retainer 1704 is fully inserted into the retainer slot 1720. Thus, the retainer 1704 may be wedged into the retainer slot 1720 such that the retainer 1704 frictionally resists withdrawal from the retainer slot 1720.

Figure 18:
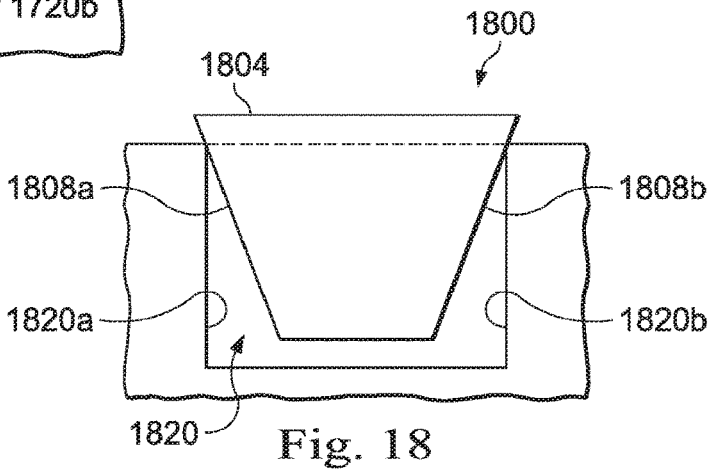

FIG. 18 is an end view of an example rolling element assembly 1800 including a single-piece wedge lock retainer 1804. The retainer 1804 includes opposing sides 1808*a,b* adjacent respective corresponding sidewalls 1820*a,b* of a retainer slot 1820. Both sides 1808*a,b* of the retainer 1804 are tapered with respect to the axial direction 1510 (FIG. 15), and both sidewalls 1820*a,b* of the retainer slot are substantially orthogonal to the axial direction 1510. An axial width of at least an upper portion of the retainer 1804 is substantially equal to or greater than an axial width of an upper end of the retainer slot 1820. Thus, the retainer 1804 may be wedged into the retainer slot 1820 such that the retainer 1804 frictionally resists withdrawal from the retainer slot 1820. As illustrated, the retainer 1804 protrudes from the upper end of the retainer slot when fully inserted therein. In other embodiments, the retainer 1804 may be fully contained within the retainer slot 1820.

Embodiments disclosed herein include:

A. A drill bit that includes a bit body having one or more blades extending therefrom, a plurality of cutters secured to the one or more blades, and a rolling element assembly positioned within a cavity defined on the bit body, the rolling element assembly including a rolling element rotatable within the cavity about a rotational axis, and a retainer extendable within a retainer slot defined in the cavity to secure the rolling element within the cavity, wherein the retainer and the cavity cooperatively encircle more than 180° but less than 360° of a circumference of the rolling element while leaving a full axial width of the rolling element exposed.

B. A rolling element assembly that includes a rolling element rotatable about a rotational axis when positioned within a cavity defined on a bit body of a drill bit, and a retainer extendable within a retainer slot defined in the cavity to secure the rolling element within the cavity, wherein the retainer and the cavity cooperatively encircle more than 180° but less than 360° of a circumference of the rolling element while leaving a full axial width of the rolling element exposed.

Each of embodiments A and B may have one or more of the following additional elements in any combination: Element 1: wherein the cavity is defined on the one or more blades. Element 2: wherein the cavity comprises an opening to receive the rolling element, a first arcuate portion that extends from one side of the opening and exhibits a first radius, a second arcuate portion that extends from an opposing side of the opening and exhibits a second radius greater than first radius; and an end wall that provides a transition between the first and second arcuate portions, wherein the retainer slot is defined in part by the second arcuate portion and the end wall. Element 3: wherein the cavity provides a first side surface and a second side surface opposite the first side surface, and wherein a bearing element is positioned on one or both of the first and second side surfaces. Element 4: wherein the retainer comprises a material selected from the group consisting of steel, a steel alloy, tungsten carbide, a sintered tungsten carbide composite, cemented carbide, polycrystalline diamond, thermally stable polycrystalline diamond, cubic boron nitride, impregnated diamond, nanocrystalline diamond, ultra-nanocrystalline diamond, zirconia, any derivatives thereof, and any combination thereof. Element 5: wherein the retainer is secured within the retainer slot using at least one of brazing, welding, an industrial adhesive, press-fitting, shrink-fitting, and a mechanical fastener. Element 6: further comprising an extraction feature defined on the retainer. Element 7: further comprising an access groove defined in the bit body to access the extraction feature. Element 8: wherein the retainer comprises an arcuate body having a polygonally symmetric or polygonally asymmetric cross-sectional shape. Element 9: further comprising one or more depressions defined in an inner arcuate surface of the retainer, and a hardfacing material received within at least one of the one or more depressions. Element 10: further comprising one or more material cavities defined in an outer arcuate surface of the retainer to retain a locking material used to secure the retainer within the cavity. Element 11: wherein the rolling element assembly is oriented on the bit body to exhibit a side rake angle ranging between 0° and 45°. Element 12: wherein the rolling element assembly is oriented on the bit body to exhibit a side rake angle ranging between 45° and 90° and thereby operates as a depth of cut controller. Element 13: wherein the rolling element assembly is oriented on the bit body to exhibit a back rake angle ranging between 0° and 45°, thereby allowing the rolling element to operate as a cutter. Element 14: wherein the rotational axis of the rolling element lies on a plane that passes through a longitudinal axis of the bit body. Element 15: wherein the rotational axis of the rolling element lies on a plane that is perpendicular to a longitudinal axis of the bit body. Element 16: wherein the rolling element exhibits a variable diameter between a first axial end and a second axial end. Element 17: wherein the retainer provides an inner arcuate surface that is concave to receive the rolling element with the variable diameter.

Element 18: wherein the retainer comprises an arcuate body having a first end and a second end opposite the first end, an arcuate inner surface extending between the first and second ends, an arcuate outer surface opposite the inner arcuate surface and extending between the first and second ends, a first sidewall extending radially between the inner and outer arcuate surfaces, and a second sidewall opposite the first sidewall and extending radially between the inner and outer arcuate surfaces. Element 19: further comprising an extraction feature defined in the outer arcuate surface. Element 20: further comprising one or more depressions defined in the inner arcuate surface, and a hardfacing material received within at least one of the one or more depressions. Element 21: further comprising one or more material cavities defined in the outer arcuate surface to retain a locking material used to secure the retainer within the cavity.

By way of non-limiting example, exemplary combinations applicable to A and B include: Element 6 with Element 7; Element 16 with Element 17; and Element 18 with Element 19.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A drill bit, comprising:

a bit body including one or more blades extending therefrom;

a plurality of cutters secured to the one or more blades;

a cavity defined on the bit body, the cavity defining a retainer slot therein;

a rolling element rotatable within the cavity about a rotational axis; and a retainer extendable within the retainer slot to secure the rolling element within the cavity, wherein the retainer and the cavity cooperatively encircle more than 180° but less than 360° of a circumference of the rolling element while leaving a full axial width of the rolling element exposed, wherein an axial width of at least one of the group consisting of the retainer and the retainer slot is tapered in an axial direction, and wherein an axial width of the retainer is equal to or greater than an axial width of the retainer slot at a corresponding position such that the retainer is frictionally engaged with sidewalls of the retainer slot.

2. The drill bit according to claim 1, wherein the retainer slot includes an offset region therein with respect to a first sidewall of the cavity, and wherein a first retainer piece of the retainer includes a protruding portion extending into the offset region to prohibit extraction of the first retainer piece from the retainer slot in a first direction.

3. The drill bit according to claim 2, wherein the retainer further comprises a second retainer piece disposed within the retainer slot, wherein second retainer piece prohibits movement of the first retainer piece in a second direction such that withdrawal of the protruding portion of the first retainer piece from the offset region of the retainer slot is prohibited.

4. The drill bit according to claim 3, wherein the rolling element comprises a generally cylindrical body rotatable within the cavity about the rotational axis defined through the cylindrical body, wherein the first direction is a circumferential direction with respect to the rotational axis, and wherein the second direction is an axial direction with respect to the rotational axis.

5. The drill bit according to claim 3, wherein the second retainer piece is wedged between the first retainer piece and a second sidewall of the cavity opposite the first sidewall.

6. The drill bit according to claim 3, further comprising a third retainer piece coupling the first and second retainer pieces to one another, wherein the third retainer piece is disposed at an opening to the cavity.

7. The drill bit according to claim 3, wherein the first and second are retainer pieces interlock with one another.

8. The drill bit according to claim 3, wherein the second retainer piece includes a protruding portion extending into the offset region of the cavity with respect to a second sidewall of the cavity.

9. The drill bit according to claim 2, wherein a second retainer piece comprises a meltable filler.

10. The drill bit according to claim 2, wherein the offset region extends helically from the first sidewall of the cavity.

11. The drill bit according to claim 2, wherein an axial width defined by an opening of the cavity is less than an axial width of an end of the retainer within the retainer slot.

12. The drill bit according to claim 2, wherein the cavity comprises:

an opening to receive the rolling element;

a first arcuate portion that extends from one side of the opening and exhibits a first radius; and a second arcuate portion that extends from an opposing side of the opening and exhibits a second radius greater than the first radius, and wherein the retainer slot is defined in the second arcuate portion adjacent the rolling element.

13. A rolling element assembly, comprising:

a rolling element rotatable about a rotational axis when positioned within a cavity defined on a bit body of a drill bit; and a retainer having at least a first retainer piece extendable within a retainer slot defined in the cavity to secure the rolling element within the cavity, wherein the first retainer piece and the cavity cooperatively encircle more than 180° but less than 360° of a circumference of the rolling element, and wherein an axial width of at least one of the group consisting of the retainer and the retainer slot is tapered in a axial direction, and wherein an axial width of the retainer is equal to or greater than an axial width of the retainer slot at a corresponding position such that the retainer is frictionally engaged with sidewalls of the retainer slot.

14. The rolling element assembly of claim 13, wherein the first retainer piece includes a protruding portion thereon extendable into an offset region of the retainer slot when the first retainer piece is inserted into the retainer slot in a first direction and shifted within the retainer slot in a second direction.

15. The rolling element assembly according to claim 14, further comprising at least one the group consisting of a second retainer piece, a mechanical fastener, a meltable filler and an epoxy disposed within the retainer slot and arranged to prohibit movement of the first retainer piece in a direction opposite the second direction.

16. The rolling element assembly according to claim 14, further comprising a second retainer piece disposed within the retainer slot, wherein each of the first and second retainer pieces is insertable individually into the retainer slot and collectively define an axial width greater than an axial width of an opening to the retainer slot.

17. The rolling element assembly according to claim 14, wherein the first retainer piece comprises an arcuate body, and wherein the protruding portion of the first retainer piece comprises a helical protrusion.

18. The rolling element assembly according to claim 17, wherein the rolling element comprises a generally cylindrical body bearing against the arcuate body of the first retainer piece.

19. The rolling element assembly according to claim 18, wherein a full axial width of the generally cylindrical body protrudes from an opening of the cavity.

20. The rolling element assembly according to claim 13, wherein at least one sidewall of the retainer slot is substantially orthogonal to the rotational axis.

* * * * *